US011427419B2

(12) United States Patent
Uchida

(10) Patent No.: US 11,427,419 B2
(45) Date of Patent: Aug. 30, 2022

(54) SHEET FEEDER AND IMAGE FORMING APPARATUS INCLUDING SHEET FEEDER

(71) Applicant: Brother Kogyo Kabushiki Kaisha, Nagoya (JP)

(72) Inventor: Mariko Uchida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/014,095

(22) Filed: Sep. 8, 2020

(65) Prior Publication Data

US 2021/0087005 A1 Mar. 25, 2021

(30) Foreign Application Priority Data

Sep. 25, 2019 (JP) ..... JP2019-174454

(51) Int. Cl.
*B65H 3/06* (2006.01)

(52) U.S. Cl.
CPC ..... *B65H 3/0638* (2013.01); *B65H 3/06* (2013.01); *B65H 3/0684* (2013.01); *B65H 2402/61* (2013.01); *B65H 2601/324* (2013.01)

(58) Field of Classification Search
CPC .. B65H 2601/324; B65H 3/06; B65H 3/0684; B65H 3/0669; B65H 3/0676; B65H 2402/61; B65H 2402/1521; B65H 2402/522; B65H 2402/5221
See application file for complete search history.

(56) References Cited

U.S. PATENT DOCUMENTS

| | | | | |
|---|---|---|---|---|
| 9,880,505 | B2 * | 1/2018 | Matsumoto | B65H 3/0684 |
| 10,584,006 | B2 * | 3/2020 | Suzuki | B65H 3/0684 |
| 2009/0072469 | A1 | 3/2009 | Toba et al. | |
| 2013/0256971 | A1 * | 10/2013 | Ueyama | G03G 21/1695 271/4.1 |

FOREIGN PATENT DOCUMENTS

JP 2009-067558 A 4/2009

* cited by examiner

*Primary Examiner* — Luis A Gonzalez
(74) *Attorney, Agent, or Firm* — Burr & Brown, PLLC

(57) ABSTRACT

A sheet feeder includes a frame, a roller holder, and a holder stopper. The roller holder includes a feed roller for feeding a sheet. The roller holder is detachably attachable to the frame. The holder stopper is configured to move between a restricting position and a non-restricting position. In a case where the holder stopper is located at the restricting position, the holder stopper restricts the roller holder from moving from an attached position at which the roller holder is fixed to the frame. In a case where the holder stopper is located at the non-restricting position, the holder stopper allows the roller holder to move relative to the frame.

17 Claims, 20 Drawing Sheets

SHEET FEEDER AND IMAGE FORMING APPARATUS INCLUDING SHEET FEEDER

CROSS-REFERENCE TO RELATED APPLICATION

This application claims priority from Japanese Patent Application No. 2019-174454 filed on Sep. 25, 2019, the content of which is incorporated herein by reference in its entirety.

TECHNICAL FIELD

Aspects disclosed herein relate to a sheet feeder and an image forming apparatus including the sheet feeder.

BACKGROUND

A known image forming apparatus such as a laser printer includes a sheet feeder including a feed roller for feeding a sheet from a sheet tray. In most cases, the feed roller is detachably attached to a body of the image forming apparatus via a roller holder so that the feed roller can be replaced in a case where the feed roller is worn out.

In the image forming apparatus, the roller holder constitutes a portion of an exterior of the body of the image forming apparatus. Such a configuration allows the image forming apparatus without a cover for covering the roller holder, thereby facilitating replacement of the feed roller.

SUMMARY

The roller holder may include an engagement portion and may be engaged with the body of the image forming apparatus via the engagement portion. In such a case, if the engagement portion of the roller holder is damaged, the roller holder may be replaced with another. Nevertheless, replacing the roller holder may cause unnecessary replacement of the feed roller.

Accordingly, aspects of the disclosure provide a sheet feeder including a roller holder constituting a portion of an exterior of the sheet feeder, thereby enabling omission of a cover for covering the roller holder and reducing or preventing unnecessary replacement of a feed roller, and also provide an image forming apparatus including the sheet feeder.

In one or more aspects of the disclosure, a sheet feeder may include a frame, a roller holder, and a holder stopper. The roller holder may include a feed roller for feeding a sheet. The roller holder may be detachably attachable to the frame. The holder stopper may be configured to move between a restricting position and a non-restricting position. In a case where the holder stopper is located at the restricting position, the holder stopper may restrict the roller holder from moving from an attached position at which the roller holder is fixed to the frame. In a case where the holder stopper is located at the non-restricting position, the holder stopper may allow the roller holder to move relative to the frame.

According to one or more aspects of the disclosure, the roller holder and the holder stopper may constitute the particular portion of the exterior surface of the frame. Such a configuration may enable omission of a cover for covering the roller holder, thereby facilitating replacement of the roller holder. The roller holder and the holder stopper may be separate members. Thus, the roller holder and the holder stopper may be replaced individually at respective timings, thereby reducing or preventing unnecessary replacement of the feed roller supported by the roller holder.

DETAILED DESCRIPTION

External Configuration of Image Forming Apparatus

Figure 1:
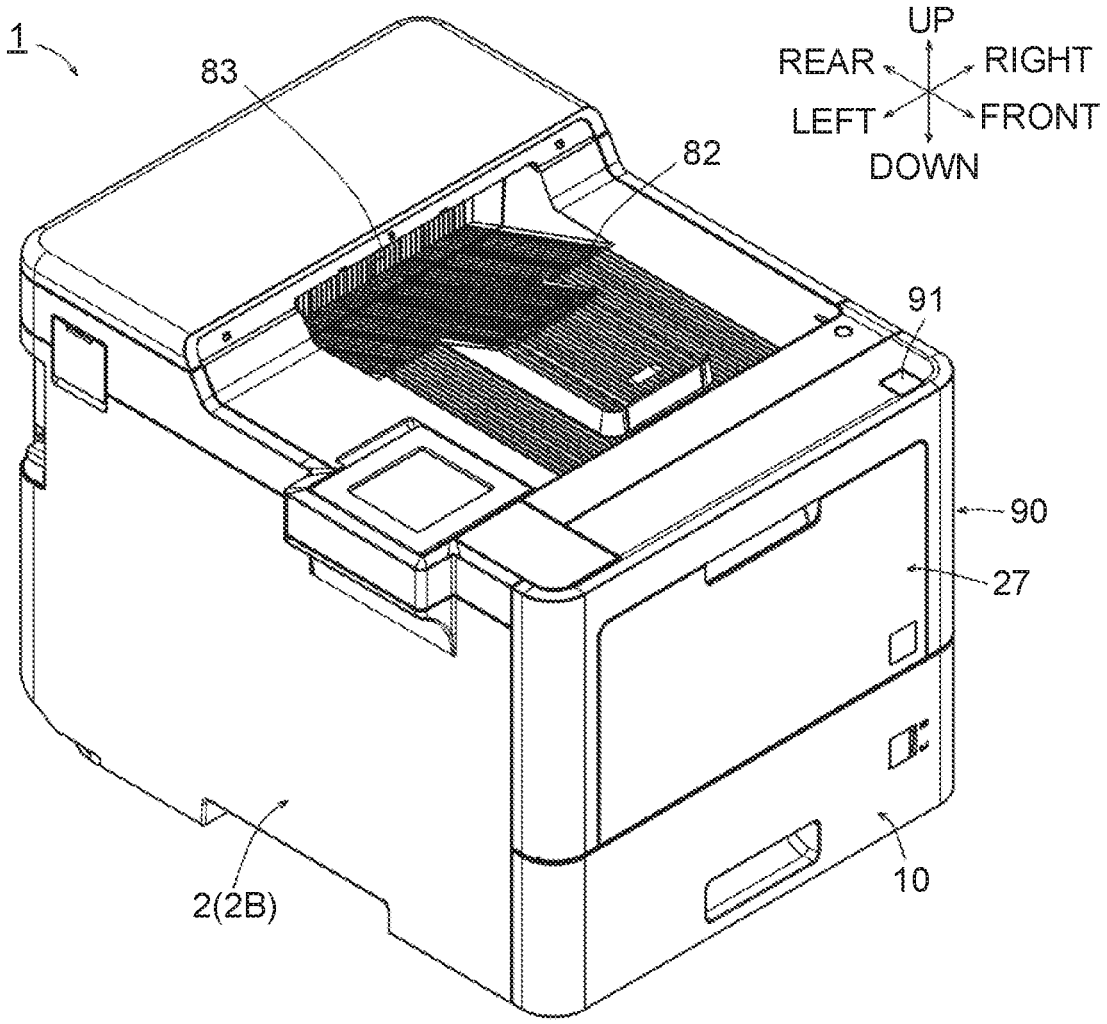
FIG. 1 is a perspective view of an image forming apparatus according to an illustrative embodiment of the disclosure, wherein its front cover is closed.
Figure 2:
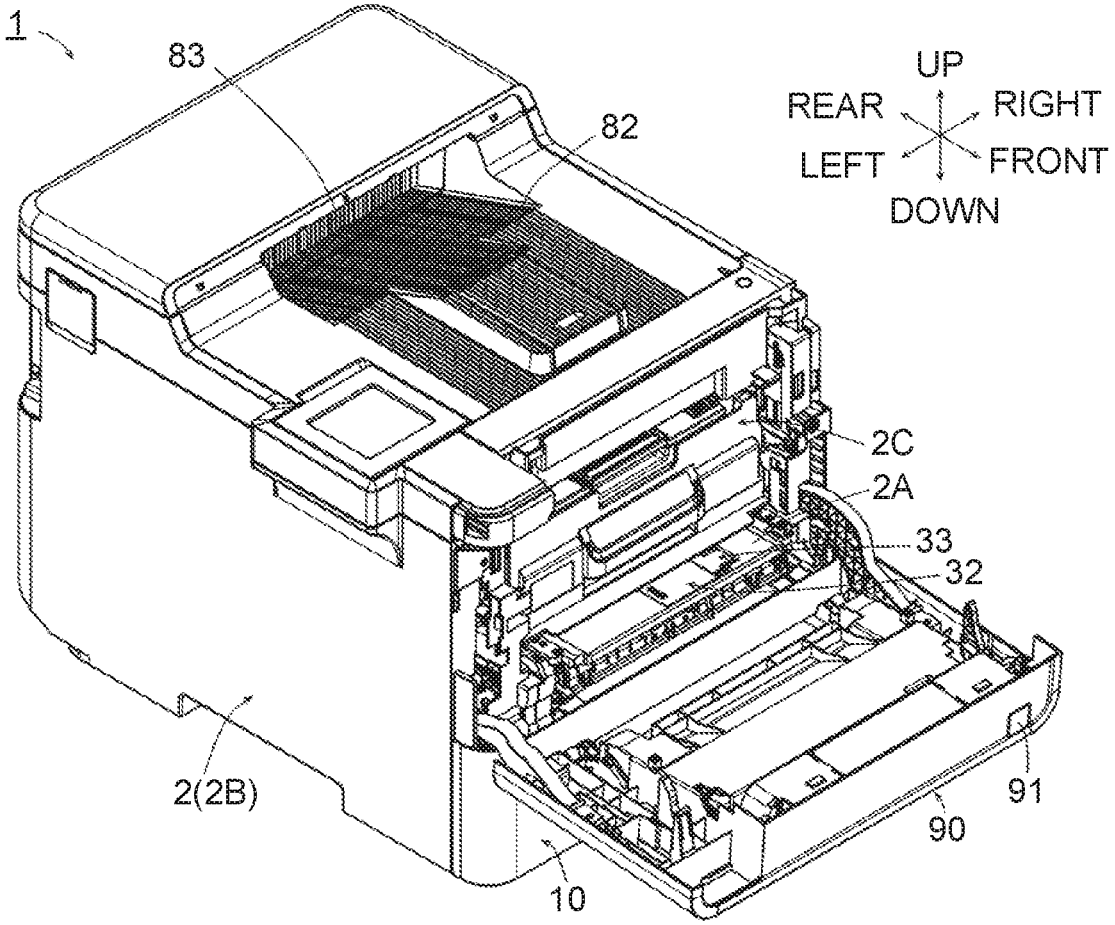
FIG. 2 is a perspective view of the image forming apparatus according to the illustrative embodiment of the disclosure, wherein the front cover is opened.
Figure 3:
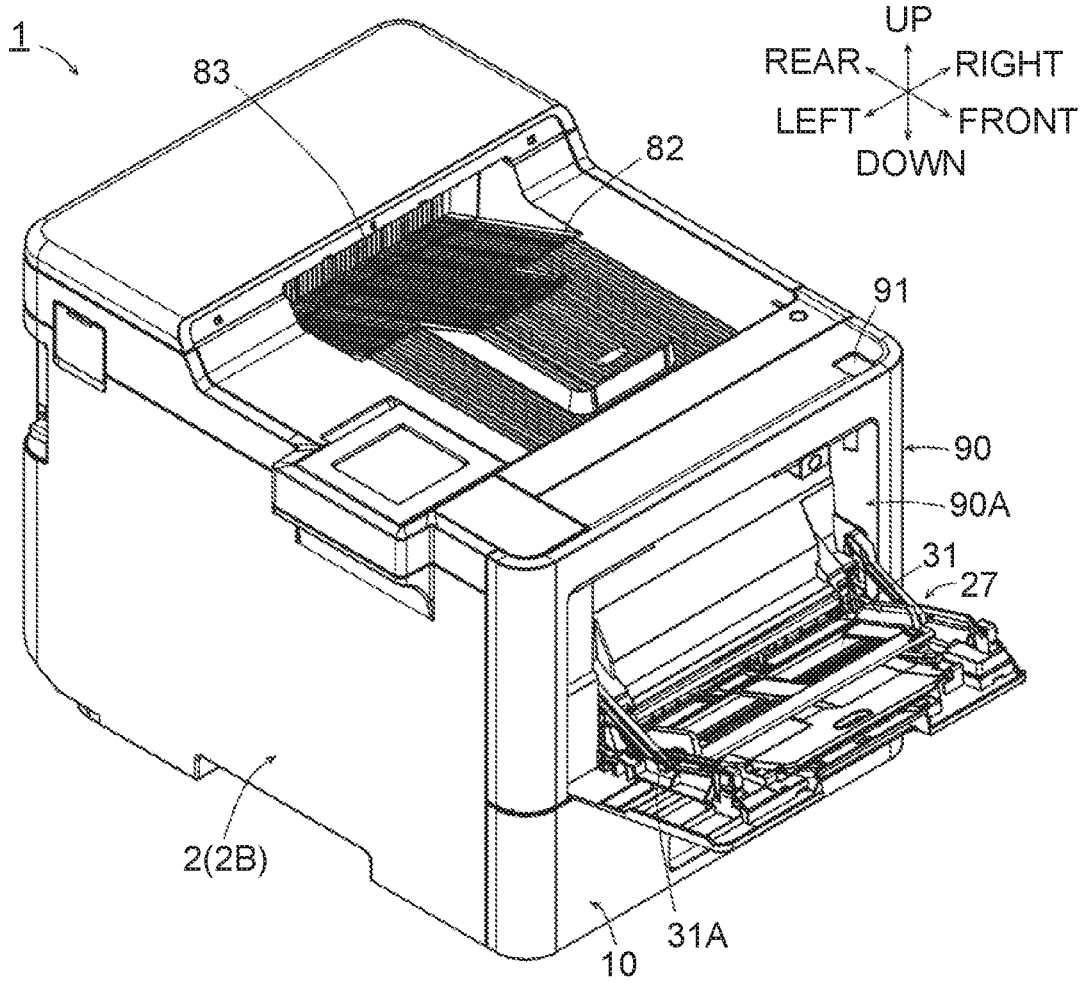
FIG. 3 is a perspective view of the image forming apparatus according to the illustrative embodiment of the disclosure, wherein its multi-purpose tray is opened.

Hereinafter, aspects of the disclosure will be described in detail with reference to the accompanying drawings. As illustrated in FIGS. 1, 2, and 3, with reference to an orientation of an image forming apparatus 1 that may be disposed in an orientation in which it may be intended to be used, a side of the image forming apparatus 1, in which a front cover 90 may be provided, may be defined as the front of the image forming apparatus 1 and its opposite side may be defined as the rear of the image forming apparatus 1. A right-left direction may be defined with respect to the image forming apparatus 1 as viewed from the front of the image forming apparatus 1. A side of the image forming apparatus 1, in which a discharge tray 82 may be provided, may be defined as an upper side of the image forming apparatus 1 and its opposite side may be defined as a lower side of the image forming apparatus 1.

In an illustrative embodiment, as illustrated in FIG. 1, the image forming apparatus 1 includes a casing 2 having a substantially rectangular parallelepiped shape. The casing 2 is one of example constituents of a sheet feeder. The casing 2 includes a frame 2A (refer to FIG. 2) and a cover 2B. The frame 2A supports units disposed in the casing 2, and constitutes a portion of an exterior of the sheet feeder when the front cover 90 is opened. The cover 2B covers the frame 2A and constitutes an exterior of the image forming apparatus 1. The casing 2 includes the discharge tray 82 at its upper surface. The discharge tray 82 is configured to receive one or more sheets S discharged from the casing 2 after printing and support the one or more discharged sheets S in a stacked manner. The discharge tray 82 has an inclined surface that is inclined downward toward the rear. The casing 2 has a discharge port 83 behind the inclined surface of the discharge tray 82. The discharge port 83 is configured to allow a sheet S to pass therethrough for sheet discharge.

As illustrated in FIG. 2, the casing 2 has a first opening 2C at its front that serves as one of side surfaces of the casing 2. The first opening 2C is provided for sheet jam clearance and for replacement of an image forming unit 5. The casing 2 includes the openable front cover 90 at its front. The front cover 90 is further configured to pivot such that a distal end, e.g., an upper end, of the front cover 90 moves between a closed position (e.g., the position of the front cover 90 in FIG. 1) and an open position (e.g., the position of the front cover 90 in FIG. 2). When the upper end of the front cover 90 is located at the closed position (hereinafter, simply referred to as "when the front cover 90 is located at the closed position"), the front cover 90 covers the first opening 2C. When the upper end of the front cover 90 is located at the open position (hereinafter, simply referred to as "when the front cover 90 is located at the open position"), the front cover 90 exposes the first opening 2C.

As illustrated in FIG. 1, the front cover 90 includes a button 91 at its upper surface and adjacent to its right end. The button 91 enables a user to open the front cover 90 by pressing. In response the user pressing the button 91 of the front cover 90 at the closed position, a lock mechanism of the front cover 90 is unlocked to allow the front cover 90 to pivot toward the open position. Thus, the user is allowed to pivot the front cover 90 frontward to open the front cover 90 to the open position (refer to FIG. 2).

As illustrated in FIG. 3, the front cover 90 has a second opening 90A at its front. The second opening 90A is configured to allow the user to manually feed one or more sheets S. The front cover 90 includes a multi-purpose tray (hereinafter, referred to as an MP tray) 27 at its front. The MP tray 27 is configured to be opened and closed and support one or more sheets S to be manually fed. The MP tray 27 is further configured to pivot such that a distal end, e.g., an upper end, of the MP tray 27 moves between a retracted position (e.g., the position of the MP tray 27 in FIG. 1) and a usage position (e.g., the position of the MP tray 27 in FIG. 3). When the upper end of the MP tray 27 is located at the retracted position (hereinafter, simply referred to as "when the MP tray 27 is located at the closed position"), the MP tray 27 covers the second opening 90A. When upper end of the MP tray 27 is located at the usage position (hereinafter, simply referred to as "when the MP tray 27 is located at the usage position"), the MP tray 27 exposes the second opening 90A.

The image forming apparatus 1 further includes a sheet cassette 10 at its lower portion. The sheet cassette 10 is configured to slide between an attached position (e.g., the position of the sheet cassette 10 in FIG. 1) and a pulled-out position. When located at the attached position, the sheet cassette 10 is positioned below the MP tray 27 in the casing 2. When located at the pulled-out position, the sheet cassette 10 is pulled out of the casing 2 and positioned further to the front than the casing 2.

Internal Configuration of Image Forming Apparatus

Figure 4:
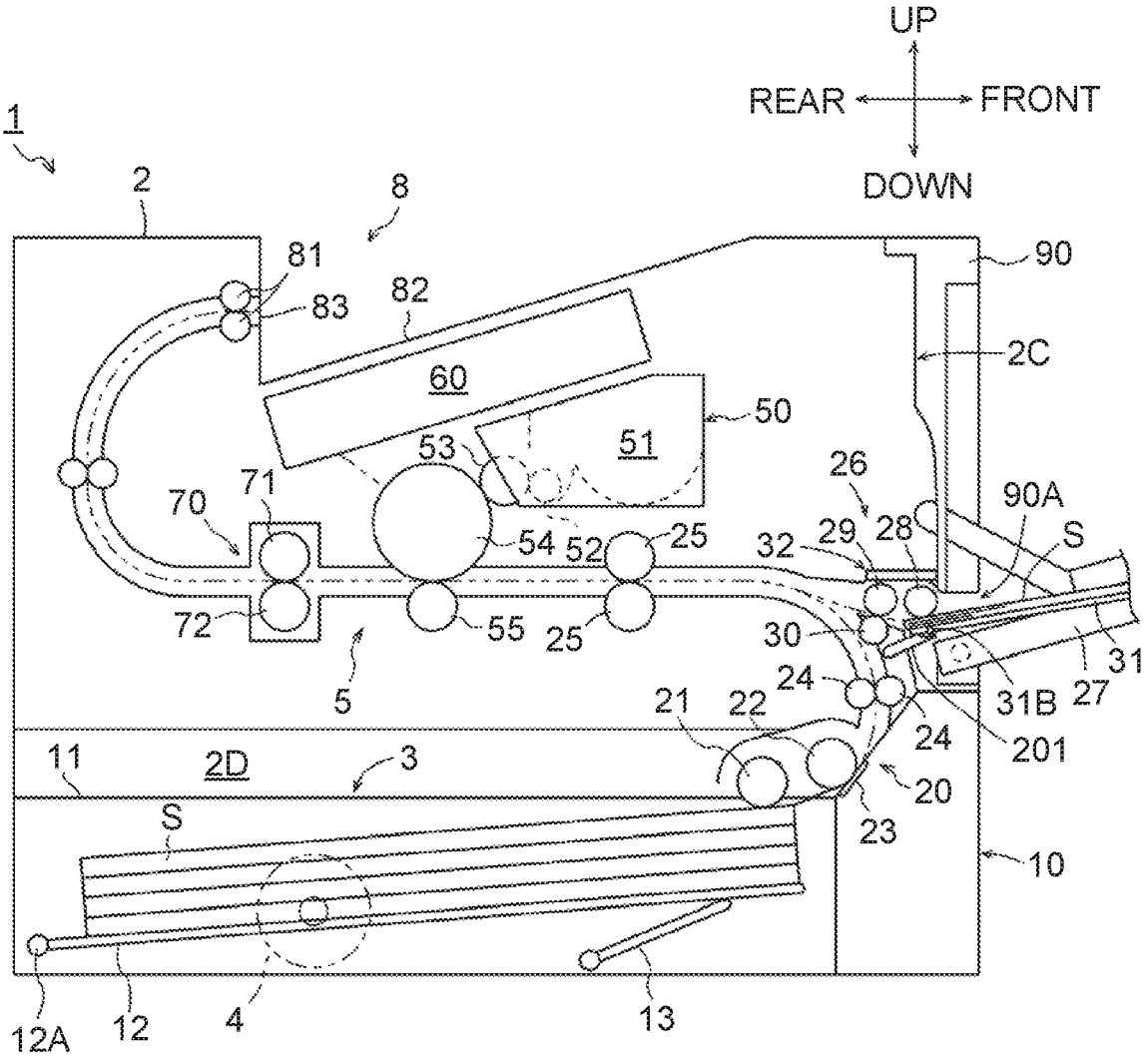
FIG. 4 is a central cross-sectional view of the image forming apparatus according to the illustrative embodiment of the disclosure.

As illustrated in FIG. 4, the image forming apparatus 1 includes, in the casing 2, a feed unit 3, a motor 4, the image forming unit 5, and a discharge unit 8. The feed unit 3 is another example constituent of the sheet feeder.

The feed unit 3 occupies a lower portion and a front portion of the image forming apparatus 1. The feed unit 3 is configured to support one or more sheets S and feed a sheet S to the image forming unit 5. The image forming unit 5 is disposed downstream from the feed unit 3 in a conveyance direction in which a sheet S is conveyed. The image forming unit 5 is configured to form an image onto a sheet S fed by the feed unit 3. The discharge unit 8 is disposed downstream from the image forming unit 5 in the conveyance direction. The discharge unit 8 is configured to discharge, to the outside of the image forming apparatus 1, a sheet S having an image thereon formed by the image forming unit 5.

The feed unit 3 includes the sheet cassette 10, a feed mechanism 20, a conveyance roller pair 24, and a registration roller pair 25 at the lower portion of the image forming apparatus 1. The feed unit 3 further includes the MP tray 27 and a feed mechanism 26 at the front portion of the image forming apparatus 1.

The casing 2 includes an attaching portion 2D in its lower portion. The sheet cassette 10 is detachably attached to the attaching portion 2D. The sheet cassette 10 is configured to allow the user to move the sheet cassette 10 rearward relative to the attaching portion 2D to insert the sheet cassette 10 into the attaching portion 2D. This may allow the sheet cassette 10 to be located at the attached position. The sheet cassette 10 is further configured to allow the user to move the sheet cassette 10 frontward relative to the attaching portion 2D to pull out the sheet cassette 10 from the attaching portion 2D. This may allow the sheet cassette 10 to be located at the pulled-out position.

The sheet cassette 10 includes a cassette body 11, a pressure plate 12, and a lifter 13. The cassette body 11 is configured to accommodate one or more sheets S loaded therein. The pressure plate 12 is disposed in the sheet cassette 10 and configured to support one or more sheets S loaded in a stacked manner in the cassette body 11 and change the position of the one or more sheets S in an up-down direction. The lifter 13 is configured to raise the pressure plate 12.

The pressure plate 12 is pivotably supported by a shaft 12A and is configured to pivot about the shaft 12A to move in the up-down direction. The lifter 13 is configured to be driven by the motor 4 such that its distal end moves upward. Upward movement of the lifter 13 raises the pressure plate 12 supporting one or more sheets S, thereby enabling the pressure plate 12 to position the one or more sheets S at a sheet feedable position where the one or more sheets S can be fed (refer to FIG. 4).

The feed mechanism 20 is configured to separate and pick up a sheet S from one or more sheets S loaded in the sheet cassette 10 and convey the separated sheet S toward the conveyance roller pair 24. The feed mechanism 20 includes a pickup roller 21, a separation roller 22, and a separation pad 23.

The pickup roller 21 is configured to pick up one or more sheets S from one or more sheets S positioned at the sheet feedable position by the pressure plate 12. The pickup roller 21 is disposed above the pressure plate 12. The separation roller 22 is disposed downstream from the pickup roller 21 in the conveyance direction. The separation pad 23 is disposed facing the separation roller 22 and is urged toward the separation roller 22.

The pickup roller 21 picks up and conveys one or more sheets S toward the separation roller 22. The separation roller 22 and the separation pad 23 then separate a single sheet S from the one or more sheets S and convey the separated sheet S toward the conveyance roller pair 24.

The conveyance roller pair 24 is configured to apply a conveyance force to a sheet S. The conveyance roller pair 24 is disposed downstream from the feed mechanism 20 in the conveyance direction. The conveyance roller pair 24 conveys the sheet S conveyed from the feed mechanism 20 toward the registration roller pair 25.

The registration roller pair 25 is disposed downstream from the conveyance roller pair 24 in the conveyance direction. The registration roller pair 25 temporarily stops the sheet S, and then conveys, toward a transfer position, the sheet S at a predetermined timing.

The MP tray 27 is configured to support one or more sheets S. The feed mechanism 26 is configured to separate and pick up a single sheet S from one or more sheets S supported by the MP tray 27 and convey, one by one, the separated sheet S toward the registration roller pair 25. The feed mechanism 26 includes a pressure plate 31, a pickup roller 28, a separation roller 29, and a retard roller 30. The pickup roller 28 is an example of a feed roller.

The pressure plate 31 is disposed at the MP tray 27 and configured to, when the MP tray 27 is located at the usage position, support one or more sheets S. The pressure plate 31 may be a plate-like member. The pressure plate 31 includes shafts 31A (only one of which is illustrated in FIG. 3) at right and left ends, respectively, of a front end portion thereof. The shafts 31A are rotatably supported by the MP tray 27. The pressure plate 31 further includes shafts 31B (only one of which is illustrated in FIG. 4) at right and left ends, respectively, of a rear end portion thereof. The shafts 31B are rotatably supported by a link 201 disposed at the casing 2. Such a configuration may thus enable the pressure plate 31 to move between a feed position and a non-feed position in response to up and down movement of the link 201. More specifically, for example, in response to the link 201 moving upward, the shafts 31B of the pressure plate 31 move upward to position the pressure plate 31 at the feed position where the pressure plate 31 contacts and presses one or more sheets S toward the pickup roller 28. In response to the link 201 moving downward, the shafts 31B of the pressure plate 31 move downward to position the pressure plate 31 at the non-feed position where the pressure plate 31 allows the one or more sheets S to be out of contact with the pickup roller 28.

The pickup roller 28 is configured to pick up one or more sheets S from one or more sheets S supported by the MP tray 27. The separation roller 29 is disposed downstream from the pickup roller 28 in the conveyance direction. The retard roller 30 is disposed facing the separation roller 29 and is urged toward the separation roller 29.

The pickup roller 28 picks up and conveys one or more sheets S toward the separation roller 29. The separation roller 29 and the retard roller 30 then separate a single sheet S from the one or more sheets S and convey the separated sheet S toward the registration roller pair 25.

The image forming unit 5 includes a process cartridge 50, an exposure unit 60, and a fixing unit 70. The process cartridge 50 is configured to transfer an image on a sheet S conveyed from the feed unit 3. The exposure unit 60 is configured to expose a surface of a photosensitive drum 54 in the process cartridge 50. The fixing unit 70 is configured to fix an image transferred on a sheet S by the process cartridge 50.

The process cartridge 50 is disposed above the attaching portion 2D in the casing 2. The process cartridge 50 includes a developer chamber 51, a supply roller 52, a developing roller 53, the photosensitive drum 54, and a transfer roller 55.

The developer chamber 51 stores toner as developer. In the process cartridge 50, an agitator supplies toner stored in the developer chamber 51 to the supply roller 52 by its agitation. The supply roller 52 then further supplies toner to the developing roller 53.

The developing roller 53 is disposed in intimate contact with the supply roller 52. The developing roller 53 is configured to carry toner supplied from the supply roller 52. The developing roller 53 is configured to receive a developing bias from a bias applying member.

The photosensitive drum 54 is disposed adjacent to the developing roller 53. After a charger uniformly charges a surface of the photosensitive drum 54, the exposure unit 60 exposes the surface of the photosensitive drum 54 to light. Exposed portions of the photosensitive drum 54 thus have a lower electric potential than the other portions, and thus an electrostatic latent image is formed on the surface of the photosensitive drum 54 based on image data. The developer roller 53 supplies charged toner to the surface of the photosensitive drum 54 with the electrostatic latent image formed thereon, thereby forming a visible developer image.

The transfer roller 55 is disposed facing the photosensitive drum 54 and is configured to receive a transfer bias from the bias applying member. In a state where the transfer bias is applied to a surface of the transfer roller 55, the photosensitive drum 54 with the developer image formed thereon and the transfer roller 55 nip and convey a sheet S by nipping the sheet S therebetween (at a transfer position), thereby transferring the developer image onto the sheet S from the surface of the photosensitive drum 54.

The exposure unit 60 includes a laser diode, a polygon mirror, lenses, and reflecting mirrors. The exposure unit 60 is configured to expose a surface of the photosensitive drum 54 by irradiating the surface with a laser beam based on image data inputted in the image forming apparatus 1.

The fixing unit 70 includes a heat roller 71 and a pressure roller 72. The heat roller 71 is configured to be driven to rotate by a drive force from the motor 4. The heat roller 71 is configured to be heated by electric power supplied from a power source. The pressure roller 72 is disposed facing and in intimate contact with the heat roller 71. The pressure roller 72 is configured to be rotated by rotation of the heat roller 71. In response to the fixing unit 70 receiving a sheet S having a developer image transferred thereon, the heat roller 71 and the pressure roller 72 convey the sheet S by nipping the sheet S therebetween to fix the developer image onto the sheet S.

The discharge unit 8 includes a discharge roller pair 81, the discharge tray 82, and the discharge port 83. The discharge roller pair 81 is configured to discharge a sheet S conveyed from the fixing unit 70 to the outside of the casing 2. The discharge tray 82 is provided at the upper surface of the casing 2. The discharge tray 82 is configured to receive and support one or more sheets S discharged to the outside of the casing 2 by the discharge roller pair 81 through the discharge port 83.

Feed Mechanism and Frame

Figure 5:
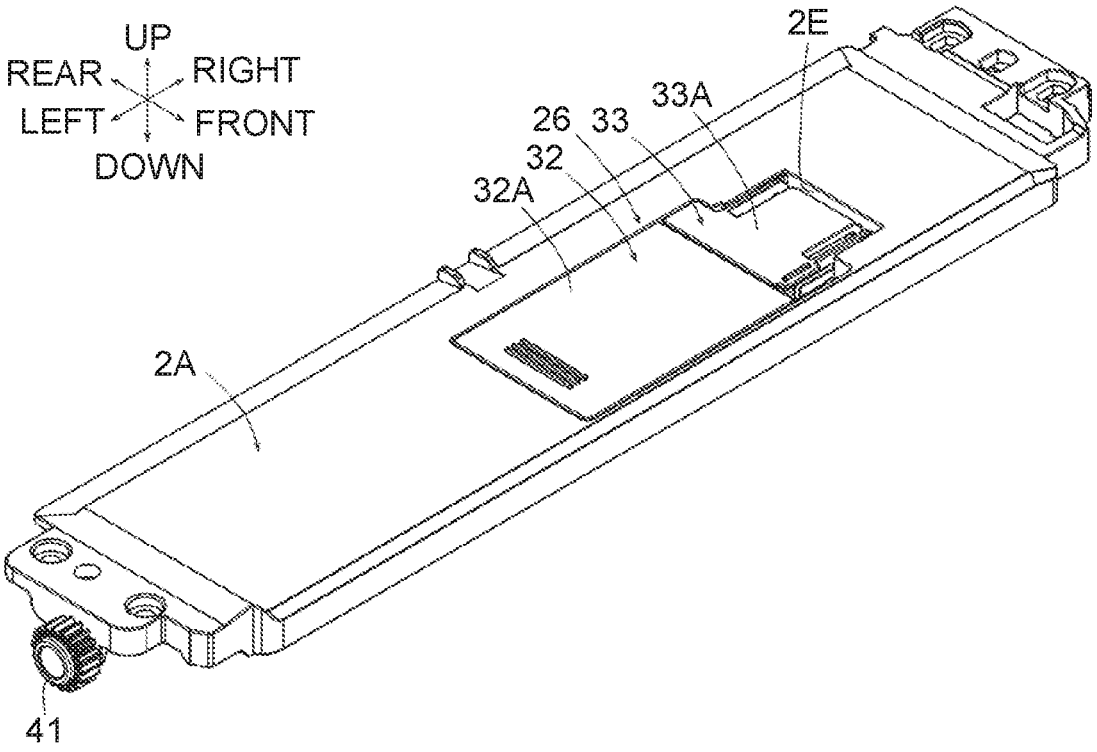
FIG. 5 is a perspective view of a roller holder, a holder stopper, and a particular portion of a frame according to the illustrative embodiment of the disclosure.
Figure 9:
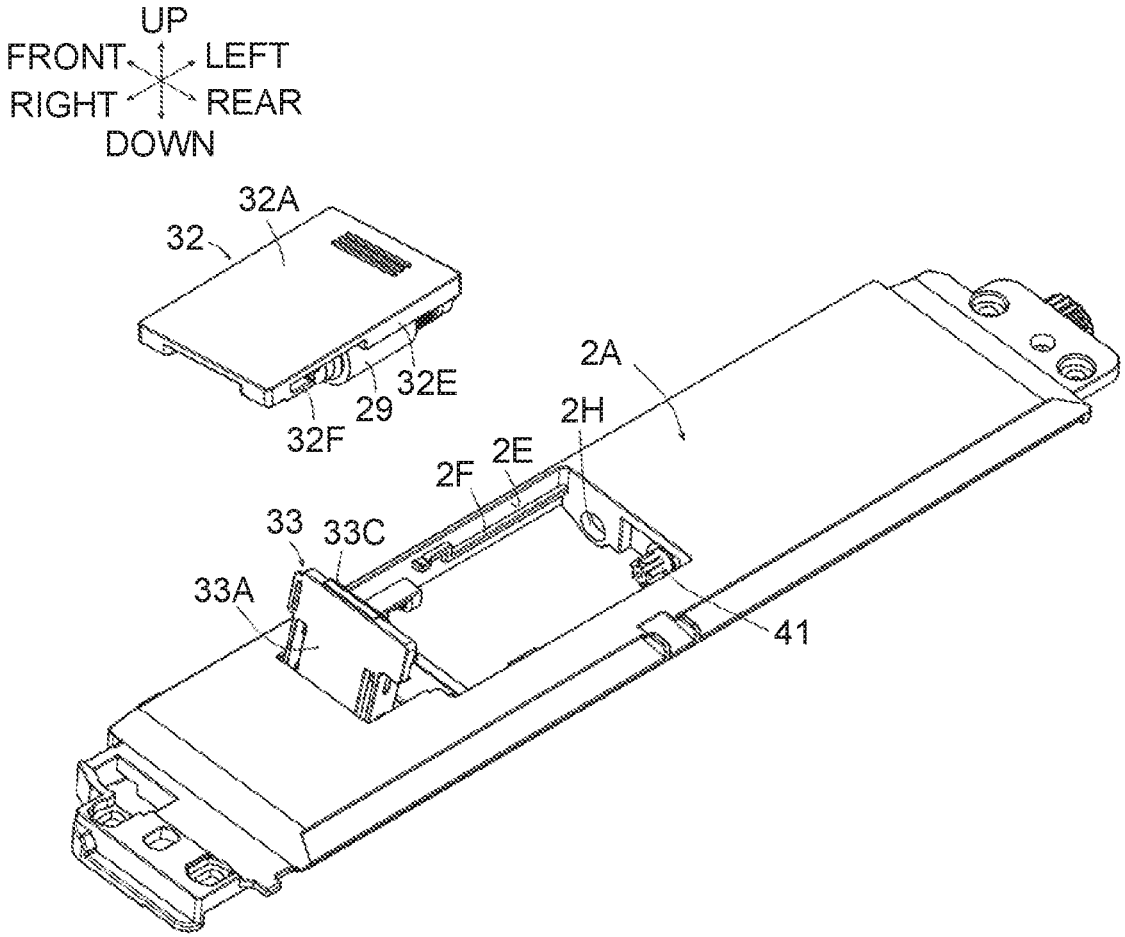
FIG. 9 is a perspective view of the roller holder, the holder stopper, and the particular portion of the frame according to the illustrative embodiment of the disclosure.
Figure 10:
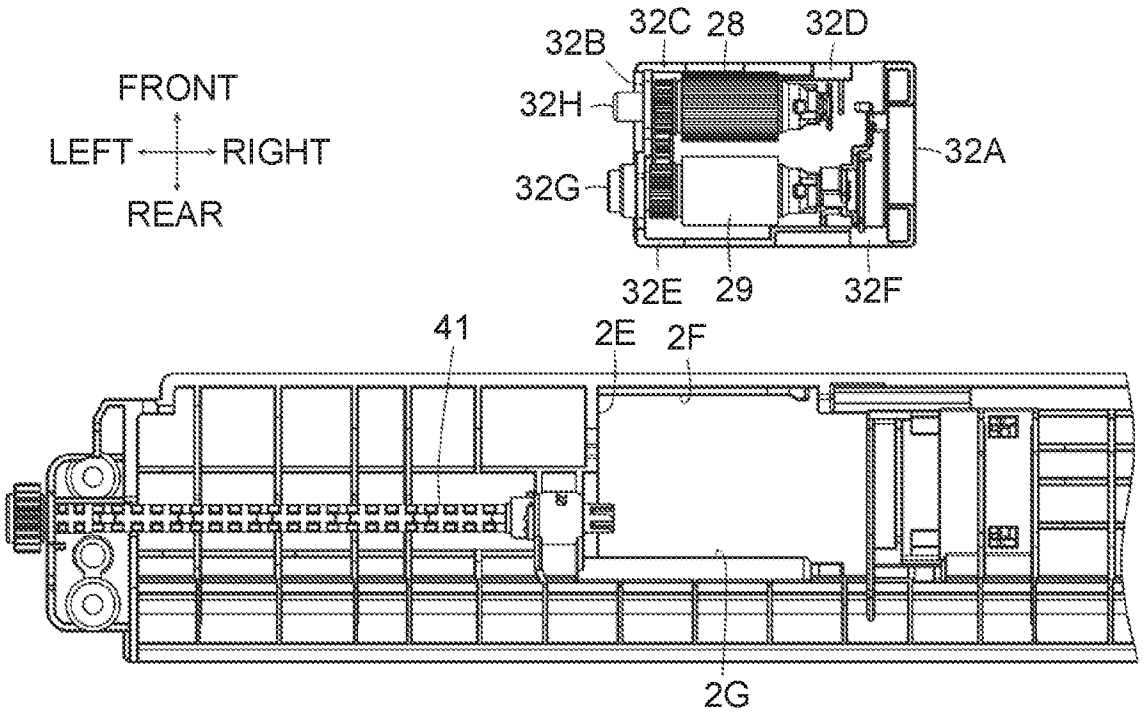
FIG. 10 is a perspective view of the roller holder, the holder stopper, and the particular portion of the frame according to the illustrative embodiment of the disclosure.

As illustrated in FIGS. 5, 9, and 10, the feed mechanism 26 includes a roller holder 32 and a holder stopper 33. The roller holder 32 holds the pickup roller 28 and the separation roller 29. The holder stopper 33 is configured to restrict movement of the roller holder 32.

The frame 2A has a hollow 2E at a position to face the first opening 2C. The hollow 2E is configured to accommodate the roller holder 32 and the holder stopper 33. A shaft 41 is attached to the frame 2A. The shaft 41 is configured to rotate the separation roller 29. The shaft 41 is further configured to be driven to rotate by a drive force from the motor 4. The shaft 41 extends to the vicinity of the hollow 2E of the frame 2A. The separation roller 29 includes a coupling 291 (refer to FIG. 10) coaxial with a rotation axis of the separation roller 29. The coupling 291 is configured to be coupled to the shaft 41.

The roller holder 32 is configured to be detachably attachable to the hollow 2E of the frame 2A. The roller holder 32 is further configured to, in a state where the roller holder 32 is engaged with the hollow 2E, be movable between an attached position (e.g., the position of the roller holder 32 in FIG. 5) and a detachable position (e.g., the position of the roller holder 32 in FIG. 7). When the roller holder 32 is located at the attached position, the roller holder 32 is fixed to the frame 2A such that the pickup roller 28 and the separation roller 29 are allowed to drive. When the roller holder 32 is located at the detachable position, the roller holder 32 is allowed to be detached from the frame 2A. In the illustrative embodiment, for example, the roller holder 32 is configured to slide in a sliding direction, e.g., in the right-left direction, between the attached position and the detachable position.

In a state where the roller holder 32 is engaged with the hollow 2E, the holder stopper 33 is disposed adjacent to the roller holder 32 in the sliding direction of the roller holder 32. The holder stopper 33 is supported by the frame 2A in the hollow 2E and configured to pivot about an axis R1 extending in a direction orthogonal to the sliding direction. The holder stopper 33 is configured to move between a restricting position (e.g., the position of the holder stopper 33 in FIG. 5) and a non-restricting position (e.g., the position of the holder stopper 33 in FIGS. 6 to 10). When the holder stopper 33 is located at the restricting position, the holder stopper 33 restricts the roller holder 32 from moving from the attached position. In other words, when the holder stopper 33 is located at the restricting position, the roller holder 32 is located at the attached position and is not allowed to be detached from the frame 2A. When the holder stopper 33 is located at the non-restricting position, the holder stopper 33 allows the roller holder 32 to move relative to the frame 2A between the attached position and the detachable position while attached to the frame 2A.

Roller Holder

The roller holder 32 includes an upper plate portion 32A, a left plate portion 32B, projecting portions 32C, 32D, 32E, and 32F, a hole 32G, and an engagement portion 32H. The upper plate portion 32A may be a substantially rectangular member. The upper plate portion 32A covers respective upper portions of the pickup roller 28 and the separation roller 29. The left plate portion 32B extends downward from a left end of the upper plate portion 32A and supports respective left end portions of the pickup roller 28 and the separation roller 29.

The projecting portion 32C extends downward from a front end of the upper plate portion 32A and is configured to slidably contact an upper surface of a rail 2F of the frame 2A. The projecting portion 32D is disposed to the right of the projecting portion 32C. The projecting portion 32D extends downward from the front end of the upper plate portion 32A and is bent leftward to further extend. The projecting portion 32D is configured to be engaged with a right end portion of the rail 2F of the frame 2A. The projecting portion 32E extends downward from a rear end of the upper plate portion 32A and is configured to slidably contact an upper surface of a rail 2G of the frame 2A. The projecting portion 32F is disposed to the right of the projecting portion 32E. The projecting portion 32F extends downward from the rear end of the upper plate portion 32A and is bent leftward to further extend. The projecting portion 32F is configured to be engaged with a right end portion of the rail 2G of the frame 2A.

The hole 32G may be a circular through hole penetrating the left plate portion 32B in the right-left direction. The hole 32G is configured to support the coupling 291 of the separation roller 29. The engagement portion 32H may be a cylindrical protrusion protruding leftward from the left plate portion 32B. The engagement portion 32H is coaxial with a rotation axis of the pickup roller 28 and is configured to be engaged with an engagement portion 2H of the frame 2A.

Holder Stopper

The holder stopper 33 includes a plate portion 33A, front and rear holes 33B, and a contact portion 33C. The plate portion 33A may be a substantially rectangular member. The holes 33B may be circular through holes penetrating respective right end portions of front and rear ends of the plate portion 33A. The holes 33B are engaged with respective corresponding protrusions 2J of the frame 2A so that the holder stopper 33 is pivotably supported by the frame 2A. The contact portion 33C is disposed at a left end of the plate portion 33A. The contact portion 33C is configured to, in a case where the holder stopper 33 is located at the restricting position, contact a right end of the roller holder 32 to restrict the roller holder 32 from moving from the attached position.

The contact portion 33C is shaped in such a manner that a distance between its end and the axis R1 of the holder stopper 33 decreases in a direction directed toward the restricting position from the non-restricting position. That is, a distance between the plate portion 33A and the contact portion 33C in a direction orthogonal to a direction in which the plate portion 33A extends decreases in proportion of the distance from the axis R1. For example, the contact portion 33C has a rounded end. Pivoting the holder stopper 33 to the restricting position enables the contact portion 33C to contact the right end of the roller holder 32 located back from the attached portion to press the roller holder 32 to the attached position.

Frame

The frame 2A further includes the two rails 2F and 2G, the engagement portion 2H, and the front and rear protrusions 2J in the hollow 2E. As illustrated in FIG. 9, the rail 2F is disposed at a front surface of an inner peripheral surface, defining the hollow 2E, of the frame 2A. The rail 2F extends in the right-left direction. The rail 2F includes a horizontal portion extending in a horizontal direction. The horizontal portion includes a particular portion extending leftward from the vicinity of a middle portion of the rail 2F. The particular portion of the rail 2F is configured to support the projecting portion 32C of the roller holder 32 from below such that the projecting portion 32C is slidable along the rail 2F in the right-left direction. The rail 2F further includes a right end portion configured to, in a case where the roller holder 32 is located at the attached position, be engaged with the projecting portion 32D of the roller holder 32 to restrict the roller holder 32 from moving in the up-down direction.

The rails 2F and 2G (refer to FIG. 8) are disposed in a mirror image arrangement with respect to the front-rear direction. The rail 2G is configured to support the projecting portion 32E of the roller holder 32 from below such that the projecting portion 32E is slidable along the rail 2G in the right-left direction, and be engaged with the projecting portion 32F to restrict the roller holder 32 from moving in the up-down direction.

As described above, the rails 2F and 2G are each shaped in such a manner to, in a case where the roller holder 32 is located at the attached position, restrict the roller holder 32 from moving in the up-down direction, and in a case where the holder stopper 33 is located at the non-restricting position, allow the roller holder 32 to slide along the rails 2F and 2G in the horizontal direction. The up and down movement of the roller holder 32 attached to the frame 2A is restricted by the rails 2F and 2G, thereby reducing or preventing the pickup roller 28 and the separation roller 29 from moving in the up-down direction due to application of load during sheet feeding. This may consequently reduce an occurrence of a sheet feeding failure.

How Roller Holder and Holder Stopper Work

Figure 7:
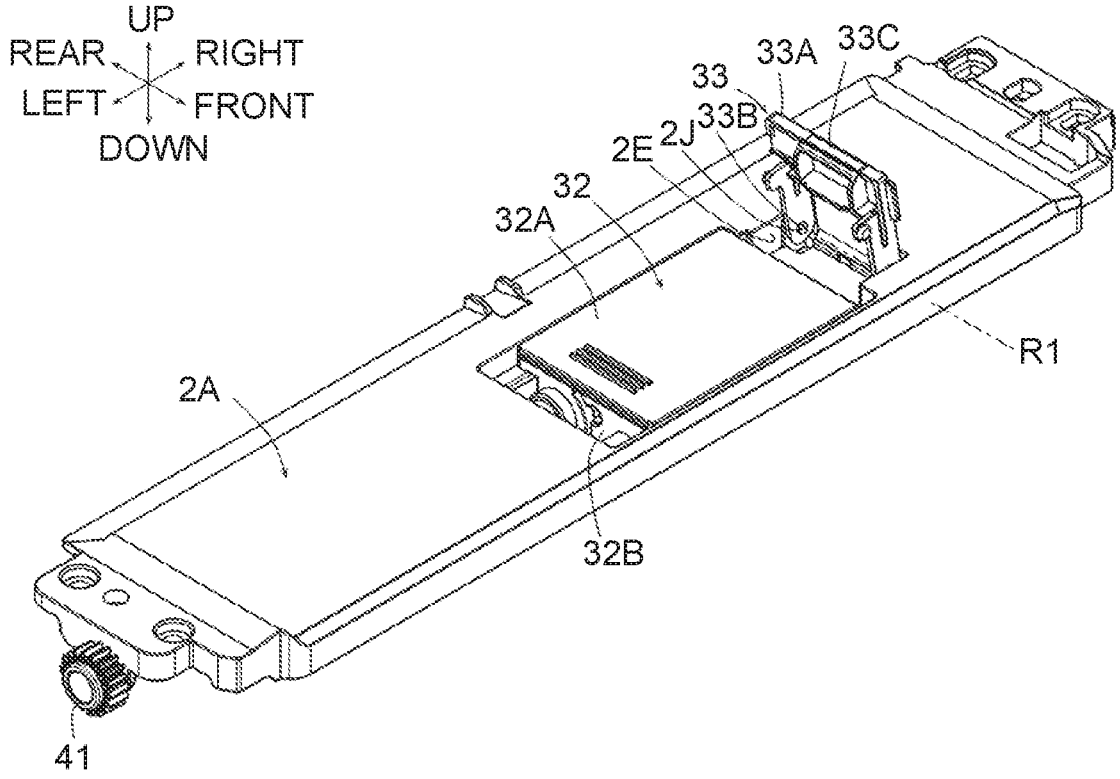
FIG. 7 is a perspective view of the roller holder, the holder stopper, and the particular portion of the frame according to the illustrative embodiment of the disclosure.
Figure 8:
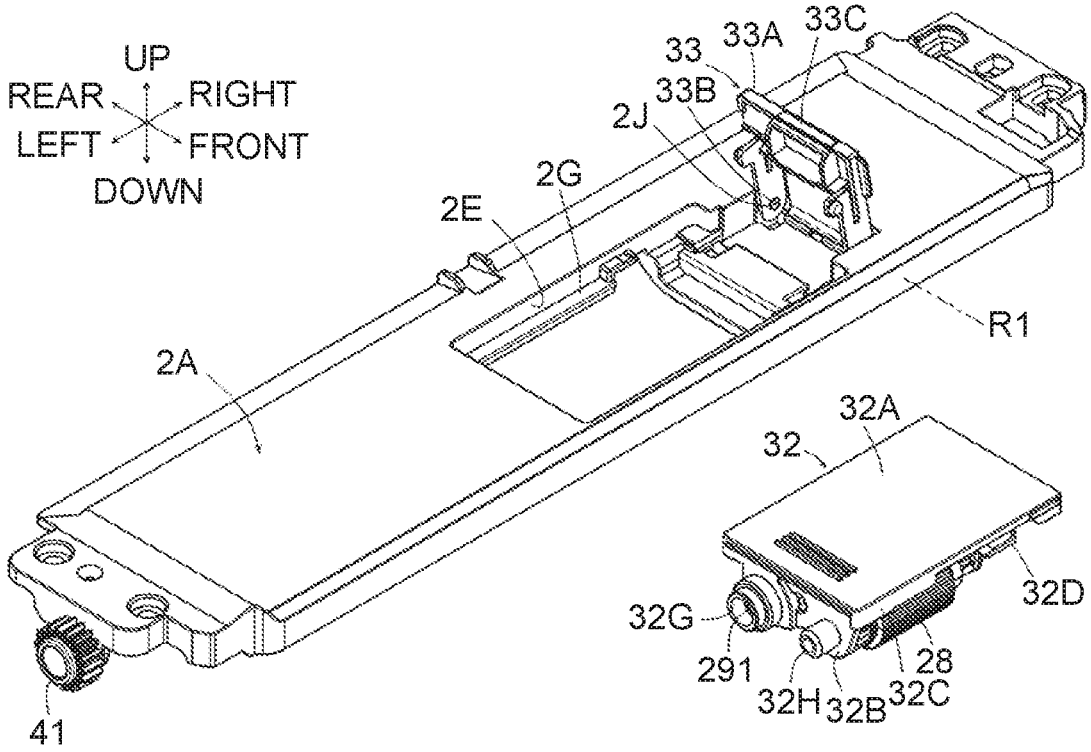
FIG. 8 is a perspective view of the roller holder, the holder stopper, and the particular portion of the frame according to the illustrative embodiment of the disclosure.

For attaching the roller holder 32 to the frame 2A, in a state where the holder stopper 33 is located at the non-restricting position (refer to FIG. 8), the roller holder 32 is placed at the detachable position in the hollow 2E of the frame 2A (refer to FIG. 7). The projecting portions 32C and 32E of the roller holder 32 thus contact and are supported by the upper surfaces of the respective rails 2F and 2G of the frame 2A.

Figure 6:
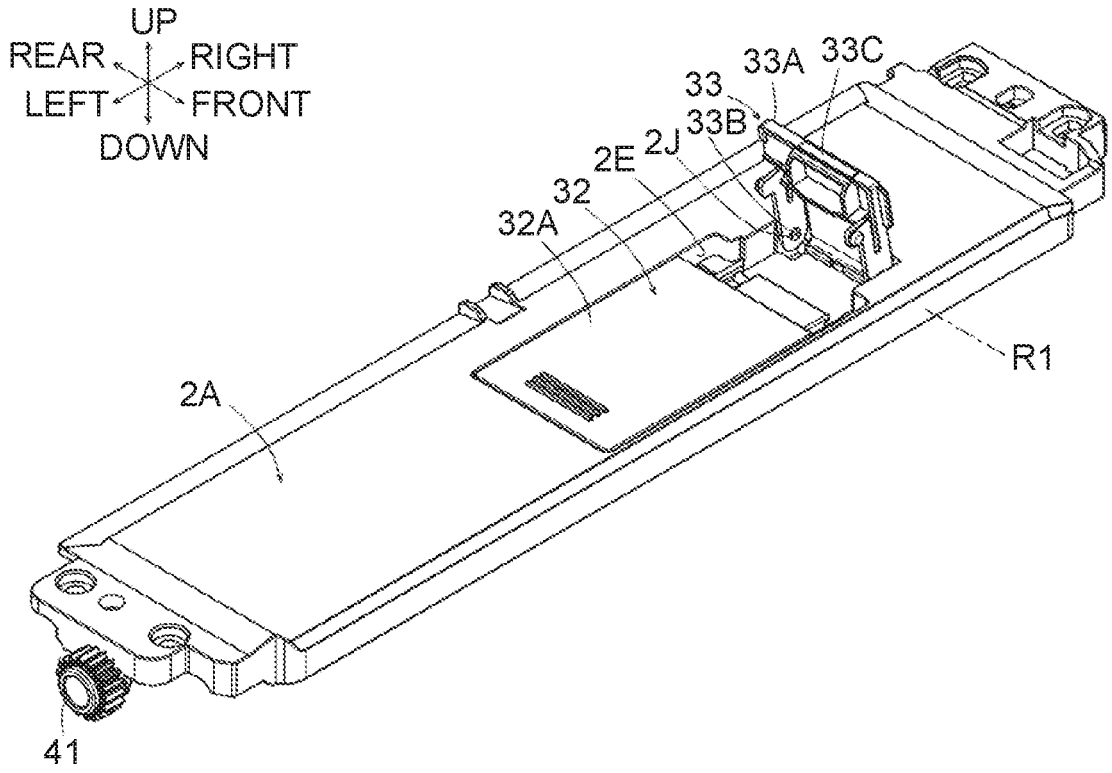
FIG. 6 is a perspective view of the roller holder, the holder stopper, and the particular portion of the frame according to the illustrative embodiment of the disclosure.

Thereafter, the roller holder 32 is slid leftward to stop at the attached position (refer to FIG. 6). At that time, the roller holder 32 slides in the sliding direction parallel to the rotation axis of the separation roller 29, and thus, the coupling 291 of the separation roller 29 is coupled to the shaft 41 and the engagement portion 32H of the roller holder 32 is engaged with the engagement portion 2H of the frame 2A.

The coupling of the coupling 291 and the shaft 41 may enable the roller holder 32 to be secured in place. In particular, the roller holder 32 is secured in place in a state where the shaft 41 is positioned coaxially with the rotation axis of the separation roller 29. This may thus effectively restrict the separation roller 29 from moving in the up-down direction due to application of load during sheet separation. The engagement of the engagement portion 32H and the engagement portion 2H may also enable the roller holder 32 to be secured in place. In particular, the roller holder 32 is secured in place in a state where the engagement portion 32H is positioned coaxially with the rotation axis of the pickup roller 28. This may thus effectively restrict the pickup roller 28 from moving in the up-down direction due to application of load during sheet feeding.

After that, the holder stopper 33 is pivoted downward to stop at the restricting position (refer to FIG. 5). At that time, even if the roller holder 32 is located back from the attached position, the contact portion 33C of the holder stopper 33 contacts the right end of the roller holder 32 to press the roller holder 32 to the attached position.

The pivotable holder stopper 33 is less likely to move toward the non-restricting position even when the holder stopper 33 located at the restricting position is pressed by the roller holder 32 in the sliding direction, thereby reducing unintentional removal of the holder stopper 33 during use.

As illustrated in FIG. 5, in a case where the roller holder 32 is located at the attached position and the holder stopper 33 is located at the restricting position, an upper surface of the upper plate portion 32A of the roller holder 32 and an upper surface of the plate portion 33A of the holder stopper 33 are flush with an upper surface of the frame 2A. In such a state, the roller holder 32 and the holder stopper 33 constitute a particular portion of an exterior surface of the frame 2A. The particular portion of the exterior surface of the frame 2A may face the first opening 2C, and may be covered by the front cover 90 when the front cover 90 is located at the closed position and may be exposed to the outside of the casing 2 when the front cover 90 is located at the open position.

As described above, the roller holder 32 and the holder stopper 33 constitute the particular portion of the exterior surface of the frame 2A. Such a configuration may enable omission of a cover for covering the roller holder 32 and the holder stopper 33, thereby facilitating replacement of the roller holder 32. The roller holder 32 and the holder stopper 33 are separate members. Thus, the roller holder 32 and the holder stopper 33 may be replaced individually at respective timings, thereby reducing or preventing unnecessary replacement of the pickup roller 28 and the separation roller 29 supported by the roller holder 32.

The casing 2 has a space above the roller holder 32. The space is used for pulling out a drawer. As described above, the roller holder 32 and the holder stopper 33 constitute the particular portion of the exterior surface of the frame 2A, thereby enabling omission of a cover for covering the roller holder 32 and the holder stopper 33. Thus, while securing a relatively large space for pulling out the drawer, such a configuration may reduce or prevent increase in size of the casing 2.

First Modification

Referring to FIGS. 11 to 15, a first modification will be described. In the description below, common parts have the same reference numerals as those of the illustrative embodiment, and the detailed description of the common parts is omitted. In the first modification, a roller holder 34 and a holder stopper 35 are used as alternatives to the roller holder 32 and the holder stopper 33, respectively, of the illustrative embodiment. A frame 2A of the first modification has a hollow 2K as an alternative to the hollow 2E of the illustrative embodiment.

The roller holder 34 is configured to be detachably attachable to the hollow 2K of the frame 2A. The roller holder 34 is further configured to, in a state where the roller holder 34 is engaged with the hollow 2K, be movable between an attached position (e.g., the position of the roller holder 34 in FIG. 11) and a detachable position (e.g., the position of the roller holder 34 in FIG. 13). When the roller holder 34 is located at the attached position, the roller holder 34 is fixed to the frame 2A such that a pickup roller 28 and a separation roller 29 are allowed to drive. When the roller holder 34 is located at the detachable position, the roller holder 34 is allowed to be detached from the frame 2A. In the first modification, for example, the roller holder 34 is configured to slide in a sliding direction, e.g., in the right-left direction, between the attached position and the detachable position.

In a state where the roller holder 34 is engaged with the hollow 2K, the holder stopper 35 is disposed adjacent to the roller holder 34 in the sliding direction of the roller holder 34. The holder stopper 35 is supported by the frame 2A in the hollow 2K and configured to slide in the sliding direction of the roller holder 34. The holder stopper 35 is configured to move between a restricting position (e.g., the position of the holder stopper 35 in FIG. 11) and a non-restricting position (e.g., the position of the holder stopper 35 in FIGS. 12 to 15). When the holder stopper 35 is located at the restricting position, the holder stopper 35 restricts the roller holder 34 from moving from the attached position. When the holder stopper 35 is located at the non-restricting position, the holder stopper 35 allows the roller holder 34 to move relative to the frame 2A.

Roller Holder

Figure 14:
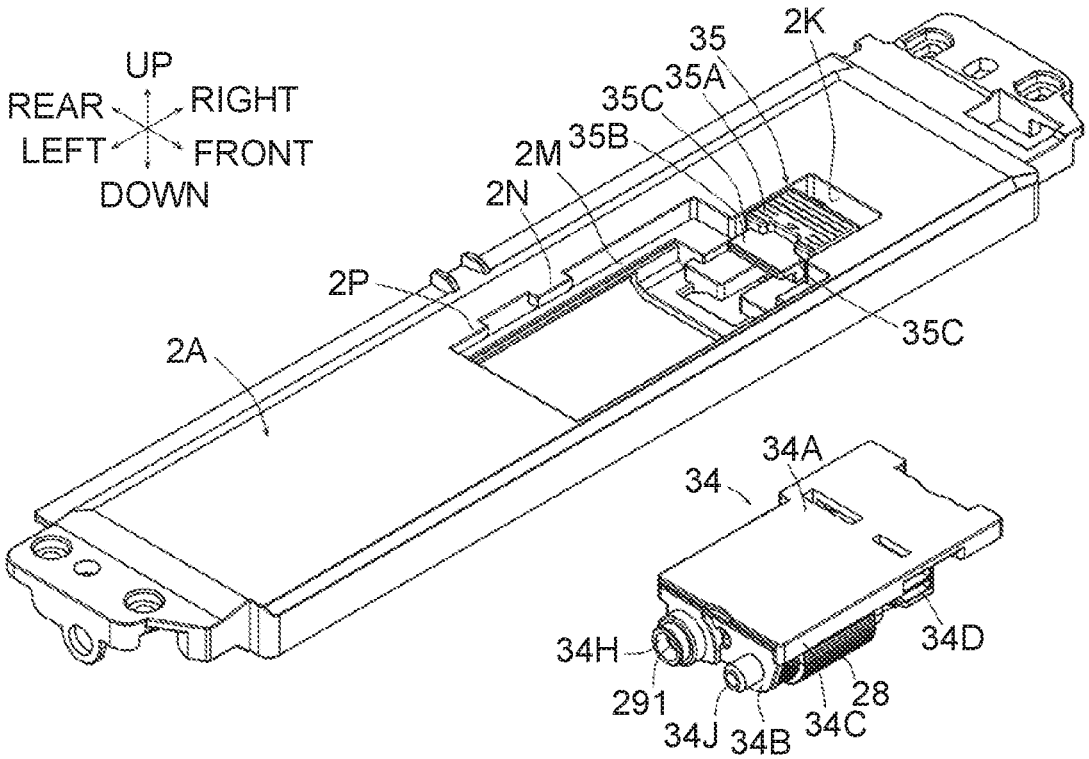
FIG. 14 is a perspective view of the roller holder, the holder stopper, and the particular portion of the frame according to the first modification of the disclosure.
Figure 15:
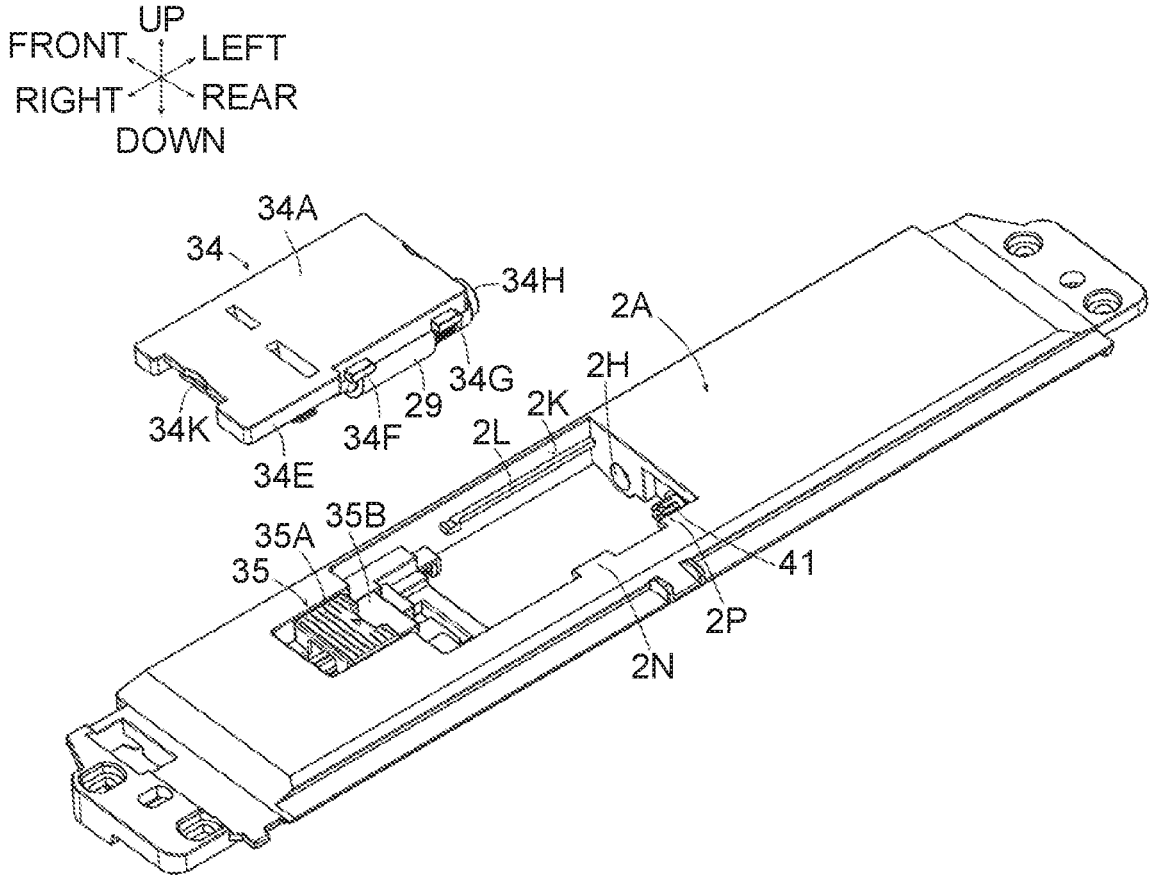
FIG. 15 is a perspective view of the roller holder, the holder stopper, and the particular portion of the frame according to the first modification of the disclosure.

As illustrated in FIGS. 14 and 15, the roller holder 34 includes an upper plate portion 34A, a left plate portion 34B, a plurality of, for example, five projecting portions 34C, 34D, 34E, 34F, and 34G, a hole 34H, an engagement portion 34J, and an elongated hole 34K. The upper plate portion 34A, the left plate portion 34B, the projecting portions 34C and 34D, the hole 34H, and the engagement portion 34J have the same respective configurations as the upper plate portion 32A, the left plate portion 32B, the projecting portions 32C and 32D, the hole 32G, and the engagement portion 32H of the illustrative embodiment.

The projecting portion 34E extends downward from a rear end of the upper plate portion 34A and is configured to slidably contact an upper surface of a rail 2M of the frame 2A. The projecting portion 34F and 34G are disposed to the left of the projecting portion 34E and extend rearward from a rear end of the upper plate portion 34A. The projecting portion 34F and 34G are configured to slidably contact the upper surface of the rail 2M of the frame 2A and also respectively contact lower surfaces of projecting portions 2N and 2P of the frame 2A. The elongated hole 34K may be a through hole penetrating a right end of the roller holder 34 in the right-left direction. The elongated hole 34K is configured to allow a projecting portion 35B of the holder stopper 35 to be inserted thereinto.

Holder Stopper

The holder stopper 35 includes a plate portion 35A, the projecting portion 35B, and a contact portion 35C. The projecting portion 35B is an example of a pressing portion. The plate portion 35A may be a substantially rectangular member. The projecting portion 35B extends leftward from a left end of the plate portion 35A. The projecting portion 35B is configured to, in a case where the holder stopper 35 is located at the restricting position, be inserted in and extend through the elongated hole 34K to restrict the roller holder 34 from moving from the attached position. The projecting portion 35B engaged with the elongated hole 34K presses the roller holder 34 downward via the elongated hole 34K, thereby reducing or preventing the roller holder 34 to come off upward from the frame 2A.

The contact portion 35C may be a left end of the plate portion 35A. Sliding the holder stopper 35 to the restricting position enables the contact portion 35C to contact the right end of the roller holder 34 located back from the attached portion to press the roller holder 34 to the attached position.

Frame

As illustrated in FIGS. 14 and 15, the frame 2A further includes a plurality of, for example, two rails 2L and 2M, an engagement portion 2H, and a plurality of, for example, two projecting portions 2N and 2P in the hollow 2K. As illustrated in FIG. 15, the rail 2L is disposed at a front surface of an inner peripheral surface, defining the hollow 2K, of the frame 2A. The rail 2L extends in the right-left direction. The rail 2L includes a horizontal portion extending in the horizontal direction. The horizontal portion is configured to support the projecting portion 34C of the roller holder 34 from below such that the projecting portion 34C is slidable along the rail 2L in the right-left direction. The rail 2L further includes a right end portion configured to, in a case where the roller holder 34 is located at the attached position, be engaged with the projecting portion 34D of the roller holder 34 to restrict the roller holder 34 from moving in the up-down direction.

As illustrated in FIG. 14, the rail 2M is disposed at a rear surface of the inner peripheral surface, defining the hollow 2K, of the frame 2A. The rail 2M extends in the right-left direction. The rail 2M is configured to support the projecting portion 34E of the roller holder 34 from below such that the projecting portion 34E is slidable along the rail 2M in the right-left direction. The projecting portions 2N and 2P extend frontward from the rear end of the inner peripheral surface, defining the hollow 2K, of the frame 2A and are configured to contact upper surfaces of the projecting portions 34F and 34G, respectively, of the roller holder 34.

As described above, the rails 2L and 2M and the projecting portions 2N and 2P of the frame 2A are each shaped in such a manner to, in a case where the roller holder 34 is located at the attached position, restrict the roller holder 34 from moving in the up-down direction, and in a case where the holder stopper 35 is located at the non-restricting position, allow the roller holder 34 to slide along the rails 2L and 2M in the horizontal direction. The up and down movement of the roller holder 34 attached to the frame 2A is restricted by the rails 2L and 2M and the projecting portions 2N and 2P, thereby reducing or preventing the pickup roller 28 and the separation roller 29 from moving in the up-down direction due to application of load during sheet feeding. This may consequently reduce an occurrence of a sheet feeding failure.

How Roller Holder and Holder Stopper Work

Figure 13:
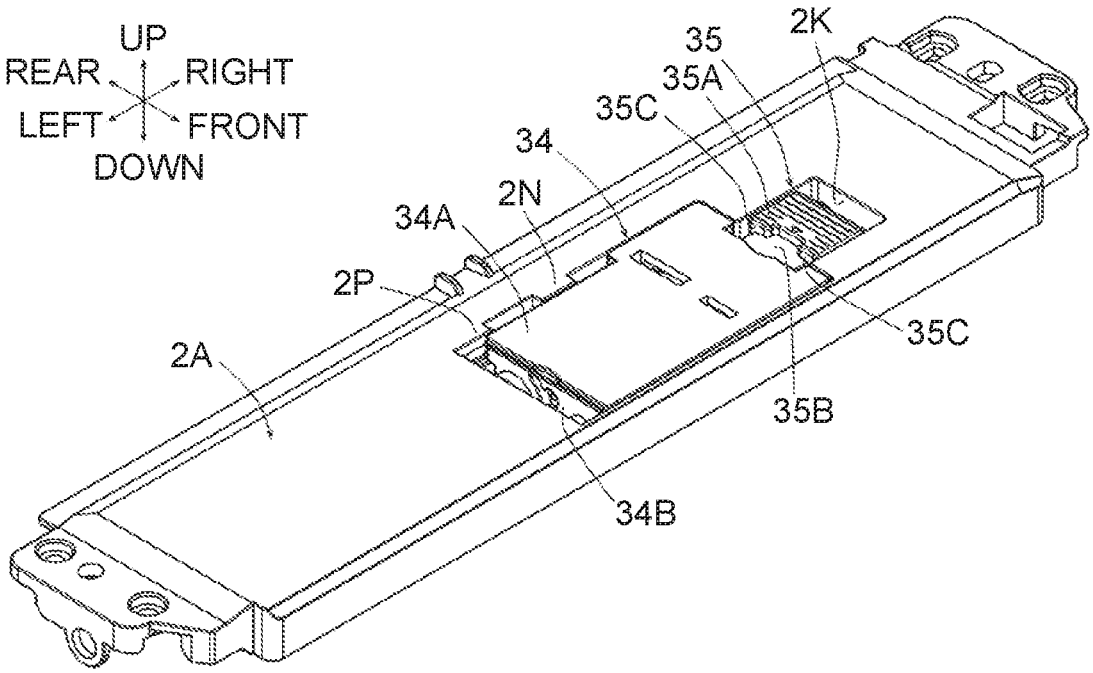
FIG. 13 is a perspective view of the roller holder, the holder stopper, and the particular portion of the frame according to the first modification of the disclosure.

For attaching the roller holder 34 to the frame 2A, in a state where the holder stopper 35 is located at the non-restricting position (refer to in FIG. 14), the roller holder 34 is placed at the detachable position in the hollow 2K of the frame 2A (refer to FIG. 13). The projecting portions 34C and 34E of the roller holder 34 thus contact and are supported by the upper surfaces of the respective rails 2L and 2M of the frame 2A.

Figure 12:
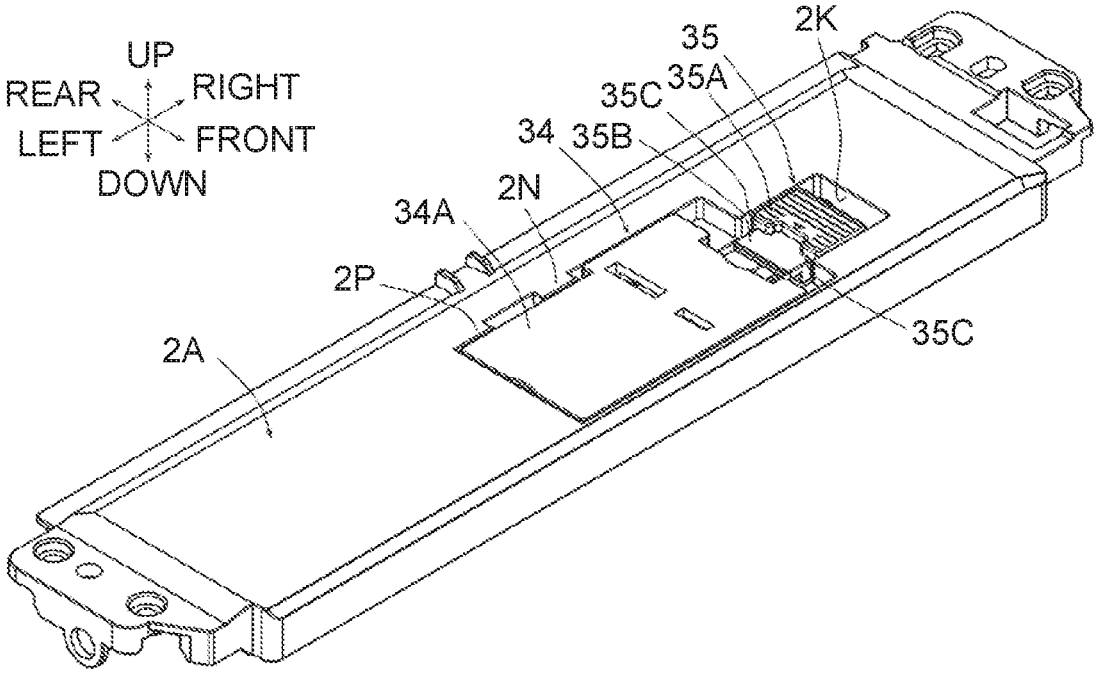
FIG. 12 is a perspective view of the roller holder, the holder stopper, and the particular portion of the frame according to the first modification of the disclosure.

Thereafter, the roller holder 34 is slid leftward to stop at the attached position (refer to FIG. 12). At that time, as with the illustrative embodiment, the coupling 291 of the separation roller 29 is coupled to the shaft 41 and the engagement portion 34J is engaged with the engagement portion 2H of the frame 2A.

Figure 11:
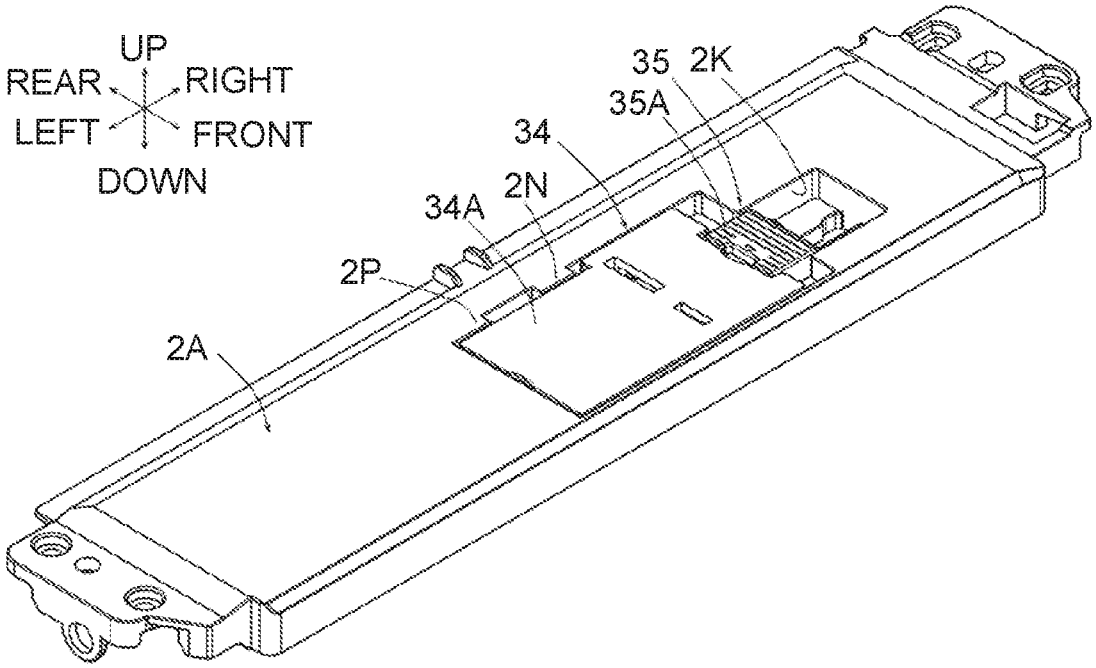
FIG. 11 is a perspective view of a roller holder, a holder stopper, and a particular portion of a frame according to a first modification of the disclosure.

After that, the holder stopper 35 is slid leftward to stop at the restricting position (refer to FIG. 11). At that time, even if the roller holder 34 is located back from the attached position, the contact portion 35C of the holder stopper 35 contacts the right end of the roller holder 34 to press the roller holder 34 to the attached position.

As illustrated in FIG. 11, as with the illustrative embodiment, in a case where the roller holder 34 is located at the attached position and the holder stopper 35 is located at the restricting position, an upper surface of the upper plate portion 34A of the roller holder 34 and an upper surface of the plate portion 35A of the holder stopper 35 are flush with an upper surface of the frame 2A. Accordingly, the first modification may achieve the same effects as those achieved by the illustrative embodiment.

Second Modification

Referring to FIGS. 16 to 20, a second modification will be described. In the second modification, a roller holder 36 and a holder stopper 37 are used as alternatives to the roller holder 32 and the holder stopper 33, respectively, of the illustrative embodiment. A frame 2A of the second modification has a cutout 2Q as an alternative to the hollow 2E of the illustrative embodiment.

The roller holder 36 is configured to be detachably attachable to the cutout 2Q of the frame 2A. The roller holder 36 is further configured to, in a state where the roller holder 36 is engaged with the cutout 2Q, be movable between an attached position (e.g., the position of the roller holder 36 in FIG. 16) and a detachable position (e.g., the position of the roller holder 36 in FIG. 18). When the roller holder 36 is located at the attached position, the roller holder 36 is fixed to the frame 2A such that a pickup roller 28 and a separation roller 29 are allowed to drive. When the roller holder 36 is located at the detachable position, the roller holder 36 is allowed to be detached from the frame 2A. In the second modification, for example, the roller holder 36 is configured to slide in a sliding direction, e.g., in the right-left direction, between the attached position and the detachable position.

In a state where the roller holder 36 is engaged with the cutout 2Q, the holder stopper 37 is disposed adjacent to the roller holder 36 in the sliding direction of the roller holder 36. The holder stopper 37 is supported in the cutout 2Q by the frame 2A and the roller holder 36 and configured to slide in a direction orthogonal to the sliding direction of the roller holder 36. The holder stopper 37 is configured to move between a restricting position (e.g., the position of the holder stopper 37 in FIG. 16) and a non-restricting position (e.g., the position of the holder stopper 37 in FIGS. 17 to 20). When the holder stopper 37 is located at the restricting position, the holder stopper 37 restricts the roller holder 36 from moving from the attached position. When the holder stopper 37 is located at the non-restricting position, the holder stopper 37 allows the roller holder 36 to move relative to the frame 2A.

Roller Holder

Figure 19:
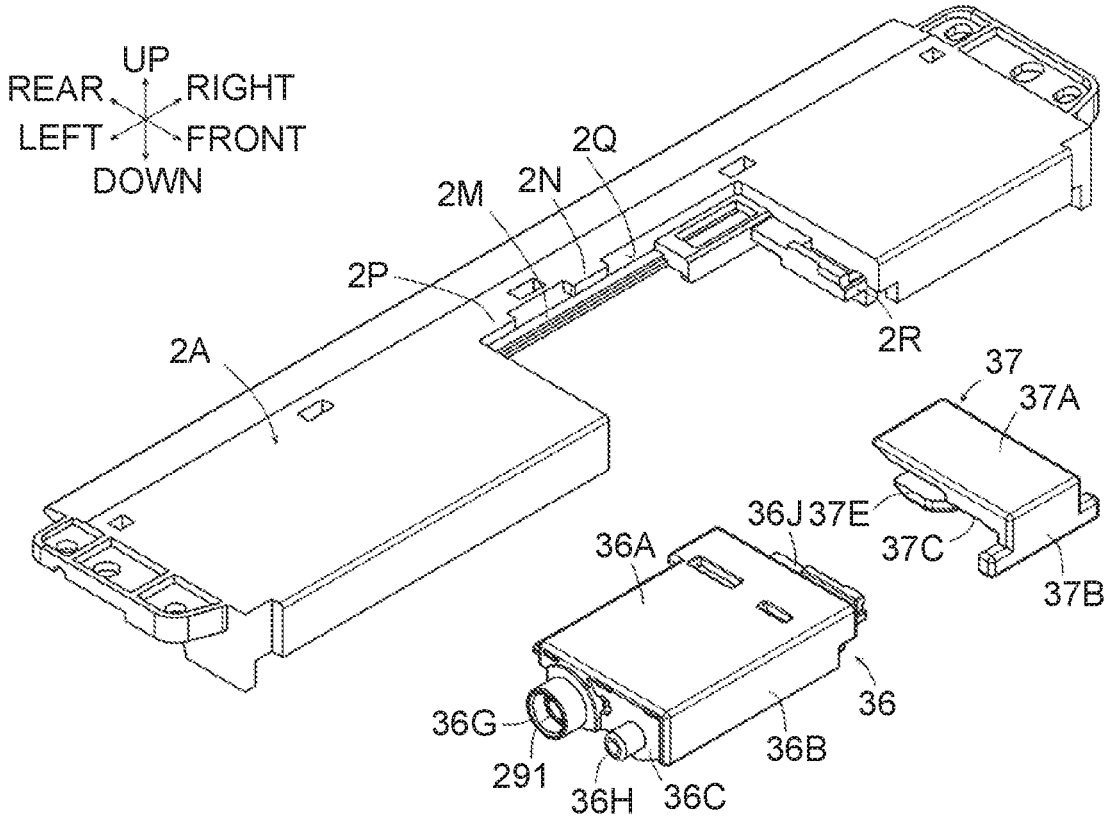
FIG. 19 is a perspective view of the roller holder, the holder stopper, and the particular portion of the frame according to the second modification of the disclosure.
Figure 20:
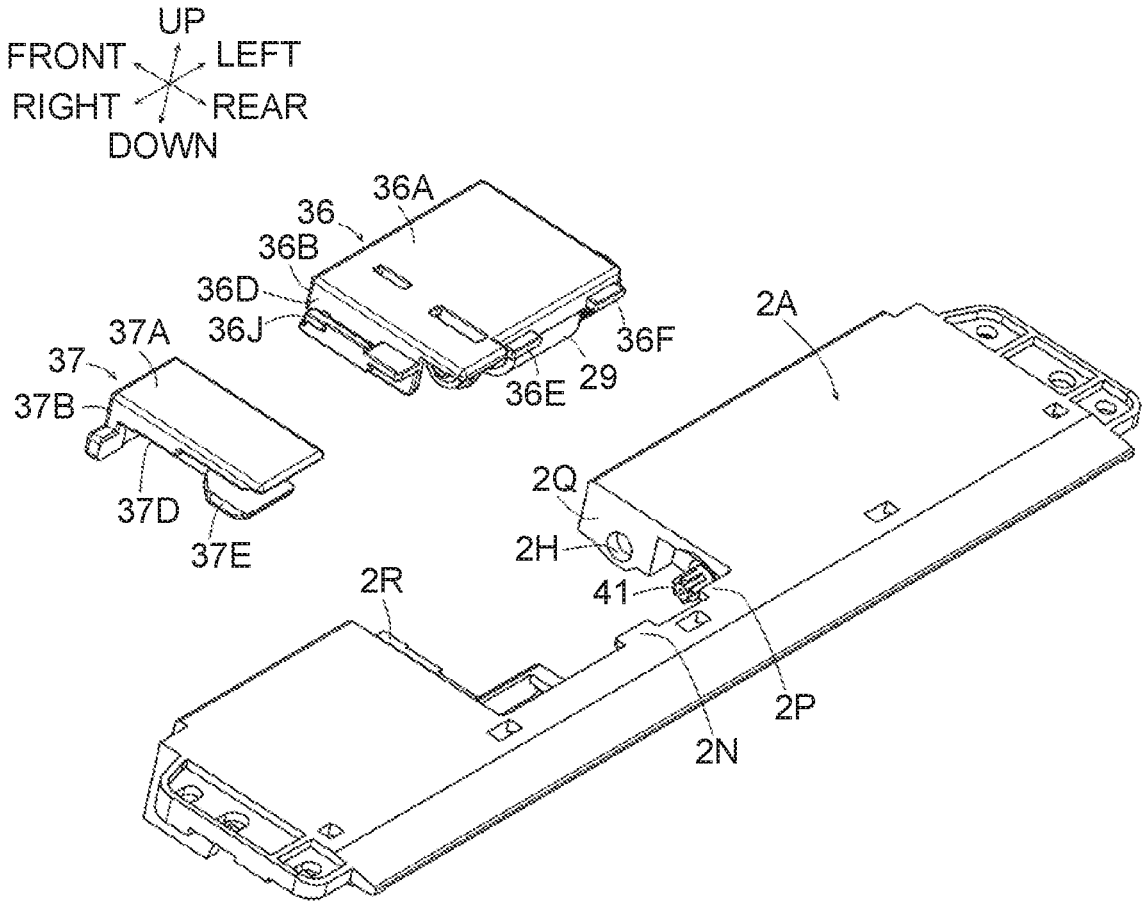
FIG. 20 is a perspective view of the roller holder, the holder stopper, and the particular portion of the frame according to the second modification of the disclosure.

As illustrated in FIGS. 19 and 20, the roller holder 36 includes an upper plate portion 36A, a front plate portion 36B, a left plate portion 36C, a right plate portion 36D, a plurality of, for example, two, projecting portions 36E and 36F, a hole 36G, an engagement portion 36H, and a rail 36J. The upper plate portion 36A, the left plate portion 36C, the hole 36G, and the engagement portion 36H have the same respective configurations as the upper plate portion 32A, the left plate portion 32B, the hole 32G, and the engagement portion 32H of the illustrative embodiment.

The front plate portion 36B extends downward from a front end of the upper plate portion 36A. In a state where the roller holder 36 is attached to the frame 2A, the front plate portion 36B is flush with a front surface of the frame 2A. The front plate portion 36B thus constitutes a particular portion of an exterior surface of the frame 2A. The right plate portion 36D extends downward from a right end of the upper plate portion 36A. The projecting portions 36E and 36F extend rearward from a rear end of the upper plate portion 36A. The projecting portions 36E and 36F are configured to slidably contact an upper surface of a rail 2M (refer to FIG. 19) of the frame 2A and also respectively contact lower surfaces of projecting portions 2N and 2P (refer to FIG. 19) of the frame 2A. The rail 36J is disposed at a right surface of the right plate portion 36D. The rail 36J extends in the right-left direction. The rail 36J includes a horizontal portion extending in the horizontal direction. The horizontal portion is configured to support a projecting portion 37C of the holder stopper 37 from below such that the projecting portion 37C is slidable along the rail 36J in the front-rear direction.

Holder Stopper

As illustrated in FIGS. 19 and 20, the holder stopper 37 includes an upper plate portion 37A, a front plate portion 37B, projecting portions 37C and 37D, and a lower plate portion 37E. The projecting portion 37C is another example of the pressing portion. The upper plate portion 37A may be a substantially rectangular member. The front plate portion 37B extends downward from a front end of the upper plate portion 37A. In a state where the holder stopper 37 is attached to the frame 2A, the front plate portion 37B is flush with the front surface of the frame 2A. The front plate portion 37B thus constitutes a particular portion of the exterior surface of the frame 2A. The front plate portion 37B includes protruding portions protruding in the right-left direction from right and left ends of its lower portion. The protruding portions are configured to be respectively engaged with a recessed portion in the front surface of the roller holder 36 and a recessed portion in the front surface of the frame 2A. Such a configuration may thus reduce or prevent the holder stopper 37 to come off upward from the frame 2A.

The projecting portion 37C extends downward from a left end of the upper plate portion 37A and is configured to slidably contact an upper surface of the rail 36J of the roller holder 36. In a case where the roller holder 36 is located at the attached position and the holder stopper 37 is located at the restricting position, the projecting portion 37C presses the rail 36J of the roller holder 36 downward, thereby reducing or preventing the roller holder 36 to come off upward from the frame 2A. The projecting portion 37C has a left surface that may contact the right plate portion 36D of the roller holder 36 located at the attached position to restrict the roller holder 36 from moving from the attached position.

The projecting portion 37D extends downward from a right end of the upper plate portion 37A and is configured to slidably contact an upper surface of a rail 2R (refer to FIG. 20) of the frame 2A. The lower plate portion 37E is disposed below and extends parallel to the upper plate portion 37A. The lower plate portion 37E is configured to slidably contact a lower surface of the rail 36J of the roller holder 36 and a lower surface of the rail 2R of the frame 2A. Such a configuration may thus enable the user to detach the holder stopper 37 by sliding the holder stopper 37 toward the user from the front of frame 2A. This may allow the user to detach the holder stopper 37 from the frame 2A readily.

Frame

The frame 2A includes, in the cutout 2Q, the rail 2R as well as the rail 2M, the projecting portions 2N and 2P, and the engagement portion 2H. The rail 2R is disposed at a right surface of an inner peripheral surface, defining the cutout 2Q, of the frame 2A. The rail 2R extends in the right-left direction. The rail 2R is configured to, in a state where the holder stopper 37 is placed at the frame 2A, be interposed between the projecting portion 37D and the lower plate portion 37E of the holder stopper 37. The rail 2R is further configured to, in a state where the holder stopper 37 is placed at the frame 2A, restrict the holder stopper 37 from moving in the up-down direction and support the holder stopper 37 such that the holder stopper 37 is slidable along the rail 2R in the front-rear direction.

The up and down movement of the roller holder 36 attached to the frame 2A is restricted by the rail 2M and the projecting portions 2N and 2P, thereby reducing or preventing the pickup roller 28 and the separation roller 29 from moving in the up-down direction due to application of load during sheet feeding. This may consequently reduce an occurrence of a sheet feeding failure.

How Roller Holder and Holder Stopper Work

Figure 18:
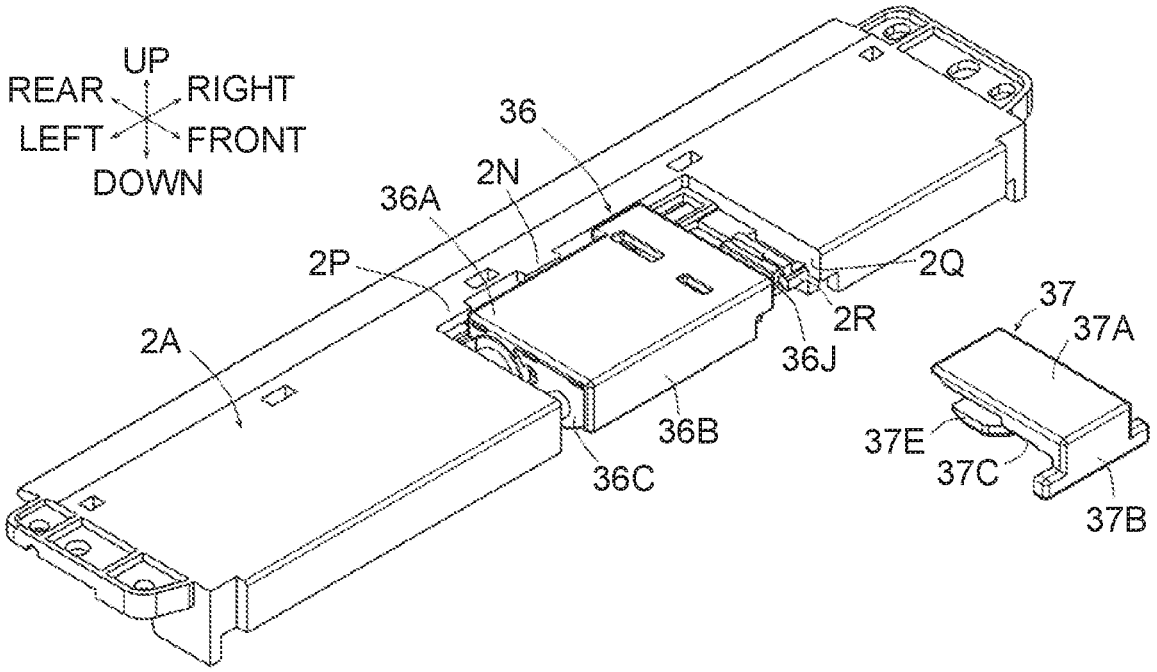
FIG. 18 is a perspective view of the roller holder, the holder stopper, and the particular portion of the frame according to the second modification of the disclosure.

For attaching the roller holder 36 to the frame 2A, in a state where the holder stopper 37 is located at the non-restricting position (refer to FIG. 19), the roller holder 36 is placed at the detachable position in the cutout 2Q of the frame 2A (refer to FIG. 18). The projecting portions 36E and 36F of the roller holder 36 thus contact and are supported by the upper surface of the rail 2M of the frame 2A.

Figure 17:
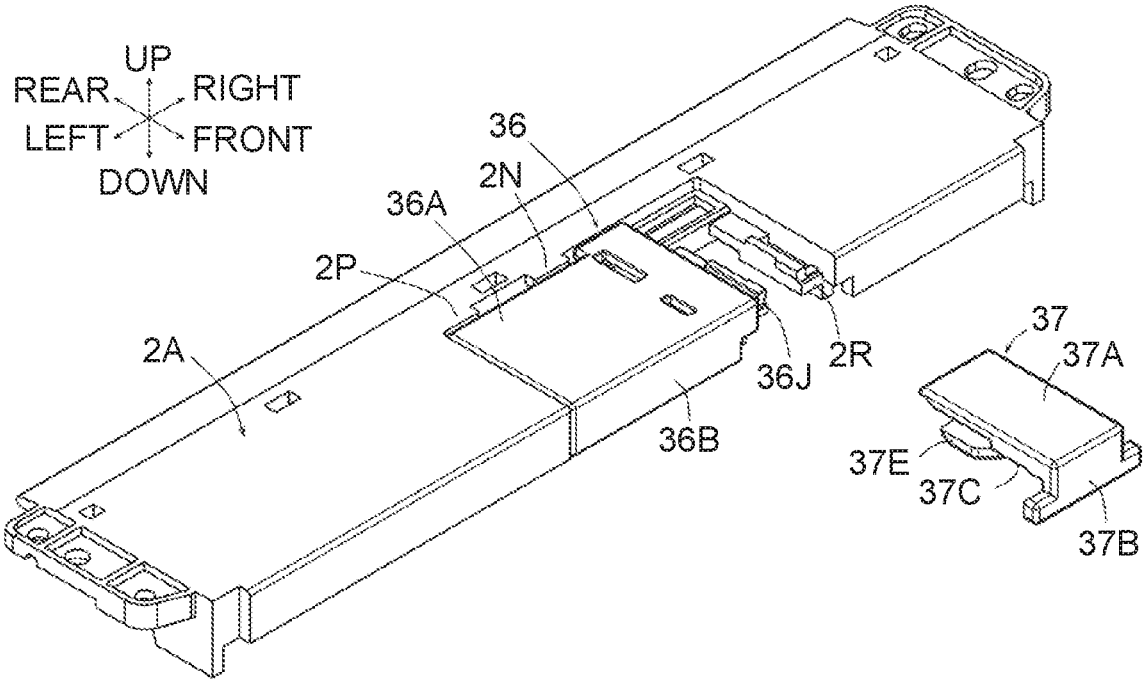
FIG. 17 is a perspective view of the roller holder, the holder stopper, and the particular portion of the frame according to the second modification of the disclosure.

Thereafter, the roller holder 36 is slid leftward to stop at the attached position (refer to FIG. 17). At that time, as with the illustrative embodiment, the coupling 291 of the separation roller 29 is coupled to the shaft 41 and the engagement portion 36H is engaged with the engagement portion 2H of the frame 2A.

Figure 16:
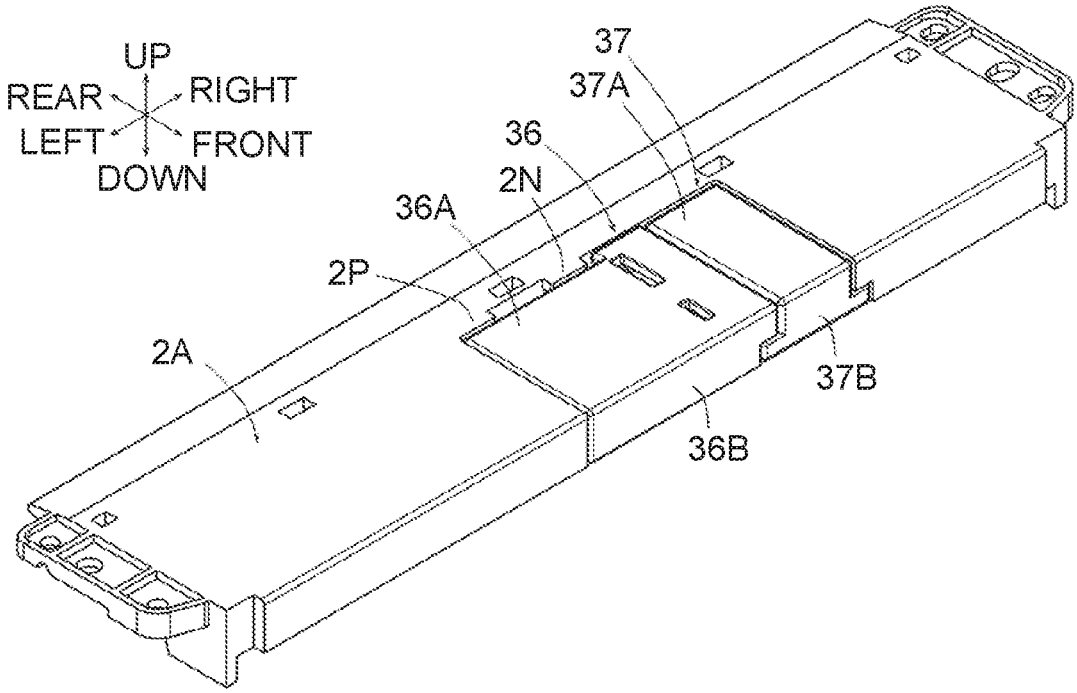
FIG. 16 is a perspective view of a roller holder, a holder stopper, and a particular portion of a frame according to a second modification of the disclosure.

After that, the holder stopper 37 is slid rearward along the rail 36J of the roller holder 36 and the rail 2R of the frame 2A to stop at the restricting position (refer to FIG. 16). The sliding direction of the roller holder 36 is orthogonal to the sliding direction of the holder stopper 37. Thus, the holder stopper 37 is less likely to move toward the non-restricting position from the restricting position even when the holder stopper 37 located at the restricting position is pressed by the roller holder 36 in the sliding direction of the roller holder 36. This may thus reduce unintentional removal of the holder stopper 37 during use.

As illustrated in FIG. 16, as with the illustrative embodiment, in a case where the roller holder 36 is located at the attached position and the holder stopper 37 is located at the restricting position, an upper surface of the upper plate portion 36A of the roller holder 36 and an upper surface of the upper plate portion 37A of the holder stopper 37 are flush with an upper surface of the frame 2A. In addition, the front surface of the upper plate portion 36B of the roller holder 36 and the front surface of the front plate portion 37B of the holder stopper 37 are flush with the front surface of the frame 2A. Accordingly, the second modification may achieve the same effects as those achieved by the illustrative embodiment.

What is claimed is:

1. A sheet feeder comprising:

a frame having a first surface configured to constitute an exterior surface of the sheet feeder;

a roller for feeding a sheet that is rotatable about an axis extending in an axial direction;

a roller holder holding the roller, wherein the roller holder is detachably attachable to the frame, wherein the roller holder includes a plate portion and a projecting portion extending from an end of the plate portion in a perpendicular direction with respect to the axial direction toward the roller, and wherein the plate portion has a second surface configured to constitute the exterior surface of the sheet feeder; and a holder stopper including a plate portion having a third surface configured to constitute the exterior surface of the sheet feeder, wherein the holder stopper is configured to move between a restricting position and a non-restricting position, restrict the roller holder from moving from an attached position at which the roller holder is fixed to the frame when the holder stopper is located at the restricting position, and allow the roller holder to move relative to the frame, when the holder stopper is located in the non-restricting position, wherein the frame includes a first rail extending in a horizontal direction, wherein the roller holder slides between an attached position, in which the roller holder is fixed to the frame, and a detachable position, in which the roller holder is allowed to be detached from the frame along the first rail, wherein the projecting portion of the roller holder contacts the first rail of the frame when the roller holder is positioned both in the detachable position and in the attached position, and wherein the second surface of the roller holder and the third surface of the holder stopper are flush with first surface of the frame when the roller holder is positioned in the attached position and the holder stopper is positioned in the restricting position.

2. The sheet feeder according to claim 1, wherein the frame has the exterior surface constituting a portion of an exterior of the sheet feeder, and wherein the roller holder and the holder stopper constitute a particular portion of the exterior surface of the frame.

3. The sheet feeder according to claim 1, wherein the rail is shaped to restrict the roller holder from moving in an up-down direction orthogonal to the horizontal direction when the roller holder is located at the attached position, and to allow the roller holder to slide along the rail in a sliding direction corresponding to the horizontal direction when the holder stopper is located in the non-restricting position.

4. The sheet feeder according to claim 3, wherein the roller holder further includes a separation roller disposed downstream from the feed roller in a conveyance direction in which a sheet is conveyed, wherein the separation roller is configured to separate a single sheet from one or more sheets fed by the feed roller, wherein the separation roller includes a coupling that is coaxial with a rotation axis of the separation roller, wherein the frame further includes a shaft configured to be coupled to the coupling and rotate the separation roller, wherein the sliding direction of the roller holder is parallel to the rotation axis of the separation roller, and wherein the coupling of the shaft is configured to, in a case where the roller holder is located at the attached position, be coupled to the shaft.

5. The sheet feeder according to claim 4, wherein the roller holder includes a first engagement portion that is coaxial with a rotation axis of the feed roller, wherein the frame further includes a second engagement portion configured to be engaged with the first engagement portion, and wherein the first engagement portion is configured to, in a case where the roller holder is located at the attached position, be engaged with the second engagement portion.

6. The sheet feeder according to claim 3, wherein, in a case where the roller holder is placed at the frame, the holder stopper is disposed adjacent to the roller holder in the sliding direction of the roller holder, and wherein the holder stopper is configured to pivot, between the restricting position and the non-restricting position, about rotation axis of the holder stopper extending orthogonal to the sliding direction of the roller holder.

7. The sheet feeder according to claim 6, wherein the holder stopper includes a contact portion configured to, in a case where the holder stopper is located at the restricting position, contact and restrict the roller holder from moving from the attached position, and wherein the contact portion is shaped in such a manner that a distance between an end of the contact portion and an axis of the holder stopper decreases in a direction directed to the restricting position from the non-restricting position.

8. The sheet feeder according to claim 6, wherein the frame has an exterior surface constituting a portion of an exterior of the sheet feeder, wherein the holder stopper includes a plate portion constituting a particular portion of the exterior surface of the frame, wherein the holder stopper includes a contact portion configured to, in a case where the holder stopper is located at the restricting position, contact and restrict the roller holder from moving from the attached position, and wherein a distance between the plate portion and the contact portion in a direction orthogonal to a direction in which the plate portion extends decreases in proportion of the distance from the rotation axis of the holder stopper.

9. The sheet feeder according to claim 6, wherein the frame includes a protrusion, wherein the holder stopper includes a hole, and wherein the hole is configured to engage with the protrusion on the rotation axis of the holder stopper.

10. The sheet feeder according to claim 3, wherein, in a case where the roller holder is placed at the frame, the holder stopper is disposed adjacent to the roller holder in the sliding direction of the roller holder, and wherein the holder stopper is configured to slide between the restricting position and the non-restricting position along the sliding direction of the roller holder.

11. The sheet feeder according to claim 3, wherein, in a case where the roller holder is placed at the frame, the holder stopper is disposed adjacent to the roller holder in the sliding direction of the roller holder, and wherein the holder stopper is configured to slide between the restricting position and the non-restricting position along a direction orthogonal to the sliding direction of the roller holder.

12. The sheet feeder according to claim 11, wherein the holder stopper constitutes a portion of an upper surface and a portion of a side surface in the exterior surface of the frame.

13. The sheet feeder according to claim 10, wherein the holder stopper further includes a pressing portion configured to, in a case where the roller holder is located at the attached position, press the roller holder downward at the restricting position.

14. The sheet feeder according to claim 1, wherein the roller holder and the holder stopper are configured to be separated from each other.

15. The sheet feeder according to claim 1, wherein the roller holder is configured to move, independently of the holder stopper, between a restricting position and a non-restricting position.

16. An image forming apparatus comprising:

the sheet feeder according to claim 1; and an image forming unit configured to form an image on a sheet fed from the sheet feeder.

17. A sheet feeder comprising:

a frame having a first surface configured to constitute an exterior surface of the sheet feeder;

a feed roller;

a roller holder, detachably attachable to the frame, that holds the feed roller, wherein the roller holder includes a plate portion and a projecting portion extending from an end of the plate portion in a perpendicular direction with respect to the axial direction toward the roller, and wherein the plate portion has a second surface configured to constitute the exterior surface of the sheet feeder; and a holder stopper including a plate portion having a third surface configured to constitute the exterior surface of the sheet feeder, wherein the holder stopper is movable between a restricting position and a non-restricting position, wherein the roller holder is allowed to move between the attached position and the detachable position while attached to the frame when the holder stopper is located at the non-restricting position, and wherein the roller holder is located at the attached position and is not allowed to be detached from the frame when the holder stopper is located at the restricting position, wherein the frame includes a first rail extending in a horizontal direction, wherein the roller holder slides between an attached position, in which the roller holder is fixed to the frame, and a detachable position, in which the roller holder is allowed to be detached from the frame along the first rail, wherein the projecting portion of the roller holder contacts the first rail of the frame when the roller holder is positioned both in the detachable position and in the attached position, and wherein the second surface of the roller holder and the third surface of the holder stopper are flush with first surface of the frame when the roller holder is positioned in the attached position and the holder stopper is positioned in the restricting position.

* * * * *